US007636540B2

(12) United States Patent
Sakai

(10) Patent No.: US 7,636,540 B2
(45) Date of Patent: Dec. 22, 2009

(54) BELT DRIVING UNIT AND, METHOD OF SWITCHING THE CONTROL LOOP BETWEEN A NORMAL AND ABNORMAL CONTROL LOOP

(75) Inventor: Yoshihiro Sakai, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 786 days.

(21) Appl. No.: 10/942,877

(22) Filed: Sep. 17, 2004

(65) Prior Publication Data

US 2005/0105937 A1 May 19, 2005

(30) Foreign Application Priority Data

Sep. 18, 2003 (JP) ..... 2003-326659
Jul. 29, 2004 (JP) ..... 2004-222270

(51) Int. Cl.
*G03G 15/16* (2006.01)

(52) U.S. Cl. ..... 399/301

(58) Field of Classification Search ..... 399/162, 399/313, 303, 302, 308, 312, 301; 347/232, 347/116; 341/8, 1, 5
See application file for complete search history.

(56) References Cited

U.S. PATENT DOCUMENTS 4,655,579 A 4/1987 Adachi et al.
4,662,739 A 5/1987 Sakai et al.
4,664,501 A 5/1987 Koizumi et al.
4,690,541 A 9/1987 Sakai et al.
4,690,542 A 9/1987 Furuta et al.
4,717,965 A 1/1988 Mashiko et al.
4,742,371 A 5/1988 Furuta et al.
4,746,950 A 5/1988 Mamizuka et al.
4,750,017 A 6/1988 Sakai
4,796,050 A 1/1989 Furuta et al.
4,922,301 A 5/1990 Katoh et al.
4,933,727 A 6/1990 Mizuma et al.
5,121,170 A 6/1992 Bannai et al.
5,160,969 A 11/1992 Mizuma et al.
5,321,475 A 6/1994 Horiuchi et al.
5,545,381 A 8/1996 Iida et al.
5,612,766 A 3/1997 Iida et al.

(Continued)

FOREIGN PATENT DOCUMENTS

JP 7-140856 6/1995

(Continued)

OTHER PUBLICATIONS

Computer Translation for applicant's cited reference JP10-232566A.*

*Primary Examiner*—Quana M Grainger
(74) *Attorney, Agent, or Firm*—Oblon, Spivak, McClelland, Maier & Neustadt, L.L.P.

(57) ABSTRACT

A belt driving unit includes a rotary belt on which a scale is formed, a sensor that reads the scale, a normal-position control loop that detects an actual position of the rotary belt based on information of the scale read by the sensor, and corrects a position of the rotary belt based on the actual belt position detected, an abnormal-condition control loop for a situation when an abnormality occurs in the normal-position control loop, and a loop-switchover timing controller that controls a switchover timing of a control loop between the normal-position control loop and the abnormal-condition control loop.

19 Claims, 18 Drawing Sheets

U.S. PATENT DOCUMENTS 5,631,691 A 5/1997 Furuta et al.
5,740,492 A 4/1998 Deki et al.
5,819,143 A 10/1998 Sakai et al.
5,825,398 A 10/1998 Furuta et al.
5,926,670 A 7/1999 Furuta et al.
5,937,232 A 8/1999 Taguchi et al.
6,029,023 A * 2/2000 Munemori et al. ..... 399/66
6,057,869 A 5/2000 Kawaishi et al.
RE37,197 E 5/2001 Iida et al.
6,259,219 B1 7/2001 Strauch et al.
6,324,358 B1 * 11/2001 Sahara ..... 399/66
7,440,133 B2 * 10/2008 Yamada et al. ..... 358/1.9
2003/0151775 A1 8/2003 Wang et al.

FOREIGN PATENT DOCUMENTS

JP 10-232566 9/1998
JP 11-24507 1/1999
JP 11-136975 5/1999
JP 2002-91264 3/2002
JP 2004122588 A * 4/2004
JP 2004157377 A * 6/2004

* cited by examiner

BELT DRIVING UNIT AND, METHOD OF SWITCHING THE CONTROL LOOP BETWEEN A NORMAL AND ABNORMAL CONTROL LOOP

CROSS-REFERENCE TO RELATED APPLICATIONS

The present document incorporates by reference the entire contents of Japanese priority documents, 2003-326659 filed in Japan on Sep. 18, 2003 and 2004-222270 filed in Japan on Jul. 29, 2004.

BACKGROUND OF THE INVENTION

1) Field of the Invention

The present invention relates to a technology for controlling a belt driving unit for an image forming apparatus, and a method of switching a control loop for the belt driving unit.

2) Description of the Related Art

Recently, many of image forming apparatuses such as a copier and a printer that can form a full color image are available, due to marketing needs. The image forming apparatus that can form color images includes, for example, a so-called tandem type image forming apparatus in which a plurality of photoconductors are aligned, and a developing apparatus that develops an image with a different color toner is respectively provided corresponding to the respective photoconductors, a single color toner image-is respectively formed on the respective photoconductors, and the single color toner images are sequentially transferred onto a belt-like or drum-like intermediate transfer unit, thereby forming a full-color synthesized color image.

The tandem type image forming apparatus includes the one of a direct transfer type, as shown in FIG. 17, in which toner images on respective photoconductors 91Y, 91M, 91C, and 91K arranged collinearly are sequentially transferred on a sheet P supported and carried on a sheet carrier belt 93 rotating in a direction of arrow A by respective transfer apparatus 92, to form a full color image on the sheet P, and the one of an indirect transfer type, as shown in FIG. 18, in which toner images on the respective photoconductors 91Y, 91M, 91C, and 91 K are sequentially transferred onto an intermediate transfer belt 94 rotating in a direction of arrow B so as to be superposed on each other, and the images on the intermediate transfer belt 94 are collectively transferred onto the sheet P by a secondary transfer apparatus 95.

The tandem type color image forming apparatus using the intermediate transfer belt, for example as shown in FIG. 18, forms a color image by superposing toner images of different colors formed on the respective photoconductors on the intermediate transfer belt. Accordingly, when the positions at which the respective color images are superposed misaligned from each other, out of color registration and change in delicate hue occur in the image, thereby deteriorating the image quality. Therefore, misalignment (out of color alignment) of the respective color toner images becomes an important problem.

The conventional apparatus that drives the transfer belt includes, for example, those disclosed in Japanese Patent Application Laid-open No. H10-232566, Japanese Patent Application Laid-open No. 2002-91264, and Japanese Patent Application Laid-open No. H11-24507.

The image forming apparatus disclosed in Japanese Patent Application Laid-open No. H10-232566 detects slits provided over the whole circumference of a transfer belt rotated by belt driving unit rollers by a sensor unit, being a first detector, encodes the speed of revolution of the belt driving unit rollers rotatably supporting the transfer belt by a second encoder, compares the speed of revolution of the belt driving unit rollers obtained by the second encoder with the belt speed detected by the sensor unit and encoded by a first encoder to calculate the slippage of the transfer belt, and corrects and controls the speed of revolution of the belt driving unit rollers so that a phase difference between the two encoders becomes zero.

The Japanese Patent Application Laid-open No. 2002-91264 discloses an image forming apparatus that reads a portion that does not include a gap between scales provided on an intermediate transfer belt along the circumferential direction by a sensor, and feedback-controls the intermediate transfer belt based on the read information.

The Japanese Patent Application Laid-open No. H11-24507 discloses a color copier in which an intermediate transfer belt (transfer belt) is rotatably laid across in a tensioned condition between five support rollers including one drive roller, and four color toner images of cyan, magenta, yellow, and black are sequentially superposed on and transferred onto the outer circumference of the intermediate transfer belt, to form a full color image.

A scale formed with fine and precise divisions is provided on the inner surface of the intermediate transfer belt in this color copier, and the scale is read by an optical detector (sensor) to accurately detect a shift position of the intermediate transfer belt. The detected shift position is feedback-controlled by a feedback control system so that the intermediate transfer belt comes to an accurate shift position.

However, the apparatus disclosed in the Japanese Patent Application Laid-open No. H10-232566 has a problem in that when the first encoder that detects the slits and encodes a signal output by the sensor unit does not normally function due to a stain or a damage, or due to deterioration over time, the position (speed) of the transfer belt cannot be corrected and controlled, since there is no other control correction unit to substitute.

The apparatus disclosed in the Japanese Patent Application Laid-open No. 2002-91264 has also a problem such that when detection cannot be performed precisely because the scale or the sensor that detects the scale is stained or damaged, or due to deterioration, the position of the transfer belt cannot be corrected and controlled, since there is no other control loop to substitute.

Further, the apparatus disclosed in the Japanese Patent Application Laid-open No. H11-24507 has a problem in that when the scale is worn out or damaged, or toner or the like adheres on the scale to stain the scale, the sensor may detection error the divisions on the scale, thereby making normal belt position control impossible.

SUMMARY OF THE INVENTION

It is an object of the present invention to solve at least the above problems in the conventional technology.

A belt driving unit according to one aspect of the present invention includes a rotary belt on which a scale is formed; a sensor that reads the scale; a normal-position control loop that detects an actual position of the rotary belt based on information of the scale read by the sensor, and corrects a position of the rotary belt based on the actual belt position detected; an abnormal-condition control loop for a situation when an abnormality occurs in the normal-position control loop; and a loop-switchover timing controller that controls a switchover timing of a control loop between the normal-position control loop and the abnormal-condition control loop.

A belt driving unit according to another aspect of the present invention includes a rotary belt on which a scale is formed; a sensor that reads the scale; a normal-position control loop that detects an actual speed of the rotary belt based on information of the scale read by the sensor, and controls the actual speed of the rotary belt to be constant; an abnormal-condition control loop for a situation when an abnormality occurs in the normal-position control loop; and a loop-switchover timing controller that controls a switchover timing of a control loop between the normal-position control loop and the abnormal-condition control loop.

An image forming apparatus according to still another aspect of the present invention includes a belt driving unit that includes a rotary belt on which a scale is formed; a sensor that reads the scale; a normal-position control loop that detects an actual position of the rotary belt based on information of the scale read by the sensor, and corrects a position of the rotary belt based on the actual belt position detected; an abnormal-condition control loop for a situation when an abnormality occurs in the normal-position control loop; and a loop-switchover timing controller that controls a switchover timing of a control loop between the normal-position control loop and the abnormal-condition control loop. The switchover of the control loop is performed at a timing out of an image forming step.

An image forming apparatus according to still another aspect of the present invention includes a belt driving unit that includes a rotary belt on which a scale is formed; a sensor that reads the scale; a normal-position control loop that detects an actual speed of the rotary belt based on information of the scale read by the sensor, and controls the actual speed of the rotary belt to be constant; an abnormal-condition control loop for a situation when an abnormality occurs in the normal-position control loop; and a loop-switchover timing controller that controls a switchover timing of a control loop between the normal-position control loop and the abnormal-condition control loop. The switchover of the control loop is performed at a timing out of an image forming step.

An image forming apparatus according to still another aspect of the present invention includes a belt driving unit that includes a rotary belt on which a scale is formed; a sensor that reads the scale; a normal-position control loop that detects an actual position of the rotary belt based on information of the scale read by the sensor, and corrects a position of the rotary belt based on the actual belt position detected; an abnormal-condition control loop for a situation when an abnormality occurs in the normal-position control loop; and a loop-switchover timing controller that controls a switchover timing of a control loop between the normal-position control loop and the abnormal-condition control loop. The loop-switchover timing controller switches the control loop from the normal-position control loop to the abnormal-condition control loop, when the abnormality occurs in the normal-position control loop, and when the normal-position control loop returns to a normal state, switches the control loop from the abnormal-condition control loop to the normal-position control loop, at a timing out of an image forming step.

An image forming apparatus according to still another aspect of the present invention includes a belt driving unit that includes a rotary belt on which a scale is formed; a sensor that reads the scale; a normal-position control loop that detects an actual speed of the rotary belt based on information of the scale read by the sensor, and controls the actual speed of the rotary belt to be constant; an abnormal-condition control loop for a situation when an abnormality occurs in the normal-position control loop; and a loop-switchover timing controller that controls a switchover timing of a control loop between the normal-position control loop and the abnormal-condition control loop. The loop-switchover timing controller switches the control loop to the abnormal-condition control loop, when the abnormality occurs in the normal-position control loop, and when the normal-position control loop returns to a normal state, switches the control loop from the abnormal-condition control loop to the normal-position control loop, at a timing out of an image forming step.

A method of switching a control loop for a belt driving unit according to still another aspect of the present invention includes switching, when an abnormality occurs in the normal-position control loop, a control loop from the normal-position control loop to an abnormal-condition control loop; and switching, when the normal-position control loop returns to a normal state, the control loop from the abnormal-condition control loop to the normal-position control loop, at a timing out of an image forming step.

The other objects, features, and advantages of the present invention are specifically set forth in or will become apparent from the following detailed description of the invention when read in conjunction with the accompanying drawings.

DETAILED DESCRIPTION

Exemplary embodiments of a belt driving unit, a method of switching a control loop for the belt driving unit, and an image forming apparatus according to the present invention will be explained in detail with reference to the accompanying drawings.

Figure 1:
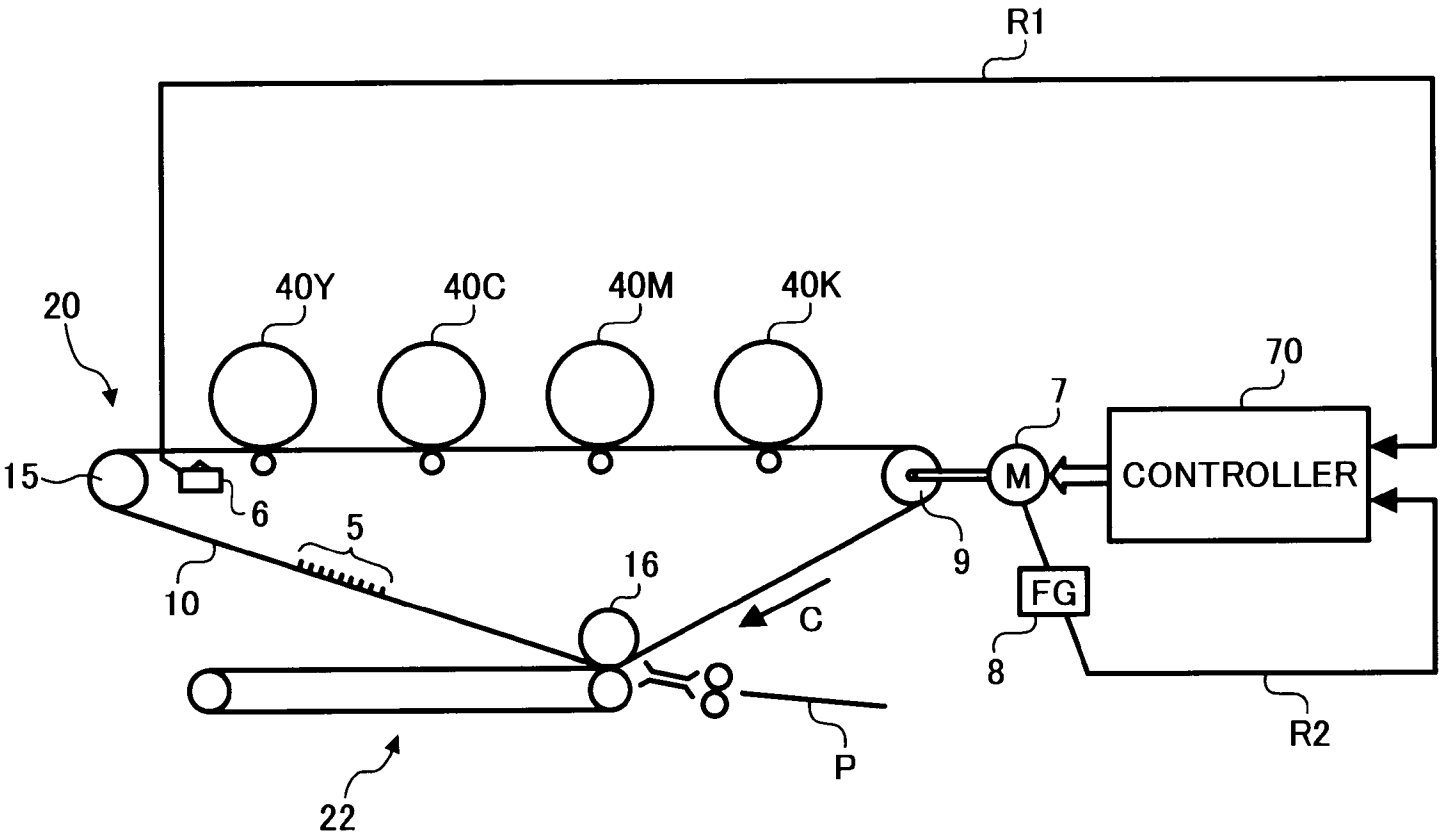
FIG. 1 is a schematic block diagram of an example of a belt driving unit according to the present invention along with a control system.
Figure 2:
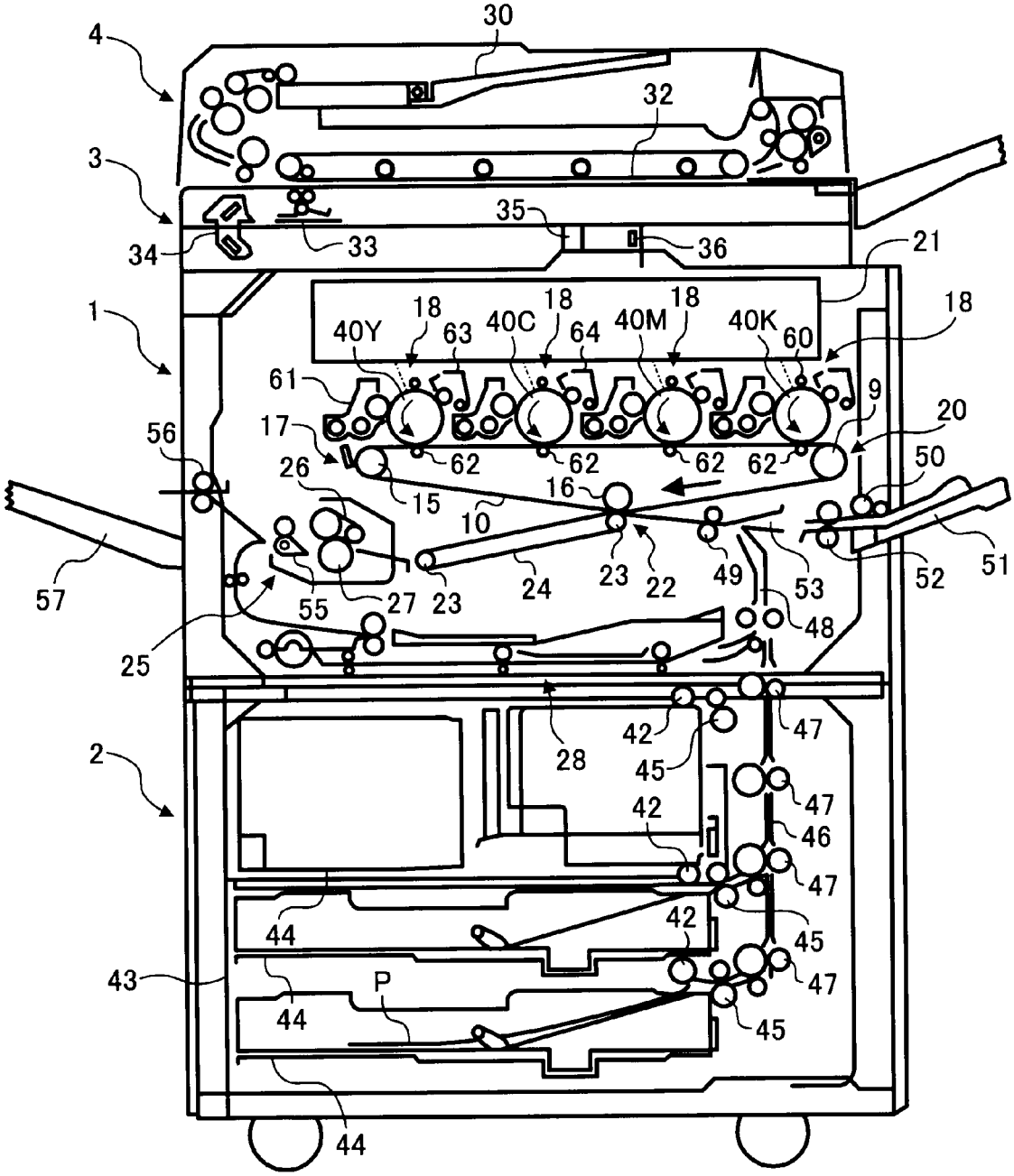
FIG. 2 is an entire block diagram of an example of a color copier, being an image forming apparatus including the belt driving unit.

FIG. 1 is a schematic block diagram of an example of a belt driving unit according to the present invention, along with a control system. FIG. 2 is an entire block diagram of a part of a color copier, being an image forming apparatus including the belt driving unit.

A belt driving unit 20 according to the embodiment includes an intermediate transfer belt 10, being an endless belt rotating in a direction of arrow C, on the whole circumference of which a scale 5 having a plurality of divisions as shown in FIG. 1 is formed (only a part thereof is shown in FIG. 1), a sensor 6 that reads the scale 5, a normal-position control loop R1 that detects an actual belt position of the intermediate transfer belt 10 from the information of the scale 5 read by the sensor 6 and corrects and controls the belt position of the intermediate transfer belt 10 corresponding to the actual belt position, and an abnormal-condition control loop R2 when an abnormal condition occurs in the normal-position control loop R1.

The belt driving unit 20 includes a controller 70 that functions as a loop switchover timing control unit that controls the switchover timing of a control loop between the normal-position control loop R1 and the abnormal-condition control loop R2.

In the embodiment, the abnormal-condition control loop R2 is a loop that corrects and controls the position of the intermediate transfer belt 10 based on a signal of a frequency generator (FG) 8 attached to the belt driving unit motor 7 that rotates the intermediate transfer belt 10, which will be explained later in detail.

The belt driving unit 20 is mounted on the color copier, being the image forming apparatus shown in FIG. 2, to form an intermediate transfer apparatus. In the color copier, the timing switching to the abnormal-condition control loop R2 when an abnormal condition occurs in the normal-position control loop R1 is a timing other than that of an image forming process, and the controller 70 shown in FIG. 1 performs the timing control.

The color copier shown in FIG. 2 is a tandem type electrophotographic apparatus using the intermediate transfer belt 10, wherein the copier main unit 1 is installed above a paper feed table 2, a scanner 3 is installed above the copier main unit 1, and an automatic document feeder (ADF) 4 is installed above the scanner 3.

The belt driving unit 20 having the intermediate transfer belt 10 is provided substantially at the center in the copier main unit 1. The intermediate transfer belt 10 is laid across in a tensioned condition between the drive roller 9 and two driven rollers 15 and 16, and rotates in the clockwise direction in FIG. 2. The residual toner remaining on the surface of the intermediate transfer belt 10 after the image transfer is removed by a cleaning apparatus 17 provided on the left side of the driven roller 15.

Drum-like photoconductors 40Y, 40C, 40M, and 40K (hereinafter, "photoconductor 40", unless otherwise specified) that form four image forming units 18 of yellow, cyan, magenta, and black, along the moving direction of the intermediate transfer belt 10 are rotatably provided in the counterclockwise direction in FIG. 2, above a straight line portion of the intermediate transfer belt 10 spanned over the drive roller 9 and the driven roller 15. Respective images (toner images) formed on the respective photoconductors are sequentially transferred in the state directly superposed on the intermediate transfer belt 10.

A charging apparatus 60, a developing apparatus 61, a primary transfer apparatus 62, a photoconductor cleaning apparatus 63, and a discharging apparatus 64 are respectively provided around the drum-like photoconductor 40. An exposure apparatus 21 is provided above the photoconductor.

On the other hand, a secondary transfer apparatus 22, being a transfer unit that transfers an image on the intermediate transfer belt 10 onto the sheet P, being a recording material, is provided below the intermediate transfer belt 10. The secondary transfer apparatus 22 is a secondary transfer belt 24, being an endless belt, spanned over between two rollers 23, 23, so that the secondary transfer belt 24 is pressed against the driven roller 16 via the intermediate transfer belt 10. The secondary transfer belt 22 batch-transfers the toner image on the intermediate transfer belt 10 onto the sheet P fed to between the secondary transfer belt 24 and the intermediate transfer belt 10.

A fixing apparatus 25 that fixes the toner image on the sheet P is located on the downstream side in a sheet carrying direction of the secondary transfer apparatus 22, where a pressure roller 27 is pressed against an endless fixing belt 26.

The secondary transfer apparatus 22 also has a function of carrying the sheet after the image transfer to the fixing apparatus 25. The secondary transfer apparatus 22 may be a transfer apparatus using a transfer roller or a contactless charger.

A sheet reversing apparatus 28 that reverses the sheet when forming the image on both sides of the sheet is provided below the secondary transfer apparatus 22.

When making a color copy, set an original document on an original table 30 in the ADF 4 in the color copier. When setting the document manually, open the ADF 4 to set the document on a contact glass 32 of a scanner 3, and close the ADF 4 to hold down the document.

When the document is set by the ADF 4, and when a start switch (not shown) is pressed, the document is fed onto the contact glass 32, and when the document is set on the contact glass 32 manually, the scanner 32 is immediately driven and a first traveling body 33 and a second traveling body 34 start traveling. The light from a light source of the first traveling body 33 is irradiated toward the document and the reflected light from the document surface is directed toward the second traveling body 34, and the light is also reflected by a mirror in the second traveling body 34 and enters into a read sensor 36 through imaging lens 35 and the content of the document is read.

The intermediate transfer belt 10 starts rotation upon pressing the start switch. At the same time, the respective photoconductors 40Y, 40C, 40 M, and 40K start rotation, to start formation of respective single color images of yellow, cyan, magenta, and black on the respective photoconductors. The respective color images formed on the respective photoconductors are sequentially transferred to and superposed on the intermediate transfer belt 10 rotating in the clockwise direction in FIG. 2, to form a synthesized full color image.

On the other hand, upon pressing the start switch, a paper feed roller 42 of a selected paper feed stage of the paper feed table 2 rotates, so that the sheet P is fed from one selected paper feed cassette 44 in a paper bank 43, and the sheet P is separated by separation rollers 45 and is carried to a paper feed route 48.

The sheet P is carried to the paper feed route 48 in the copier main unit 1 by carrier rollers 47, and hits a resist roller pair 49 and stops temporarily.

In the case of manual feed, the sheet P set on a manual feed tray 51 is fed by the rotation of a paper feed roller 50 and separated by a separation roller pair 52, and carried to a manual paper feed route 53 and hits the resist roller pair 49 and stops temporarily.

The resist roller pair 49 starts rotation at an accurate timing matched with the synthesized color image on the intermediate transfer belt 10, to feed the temporarily stopped sheet P to between the intermediate transfer belt 10 and the secondary transfer apparatus 22. The color image is then transferred onto the sheet P by the secondary transfer apparatus 22.

The sheet P onto which the image has been transferred is carried to the fixing apparatus 25 by the secondary transfer apparatus 22 also having a function as a carrier device, where heat and pressure are applied thereto, thereby fixing the transferred image. Thereafter, the sheet P is guided to the ejection side by a switching claw 55, ejected onto a paper ejection tray 57 by a paper ejection roller pair 56 and stacked there.

When the two-sided copying mode is selected, the sheet P on which an image is formed on one side is carried toward the sheet reversing apparatus 28 by the switching claw 55, reversed and guided again to the transfer position, to form an image on the back, and then ejected onto the paper ejection tray 57 by the paper ejection roller pair 56.

In the color copier, as explained with reference to FIG. 1, in the control using the normal-position control loop R1, the actual belt position of the intermediate transfer belt 10 is detected from the information obtained by reading the scale 5 on the intermediate transfer belt 10 by the sensor 6, and the belt position of the intermediate transfer belt 10 is corrected and controlled corresponding to the actual belt position. The belt position detection system and the drive system of the intermediate transfer belt 10 will be explained here with reference to FIGS. 3 and 4.

As shown FIG. 1, the rotatory power of the belt driving unit motor 7 is transmitted to the drive roller 9 driving the belt, over which the intermediate transfer belt 10 is rotatably laid across in a tensioned condition.

Thus, the belt driving unit motor 7 rotates the intermediate transfer belt 10 in a direction of arrow C in FIG. 1 by rotating the drive roller 9. Transmission of the rotatory power may be direct transmission or via a gear.

The intermediate transfer belt 10 is a belt formed of, for example, fluororesin, polycarbonate resin, or polyimide resin, and an elastic belt in which the whole layer or a part of the belt is formed of an elastic member may be used.

The single color images (toner images) of different colors formed on the photoconductors 40Y, 40C, 40M, and 40K are sequentially transferred onto and superposed on the intermediate transfer belt 10 in this order.

Figure 3:
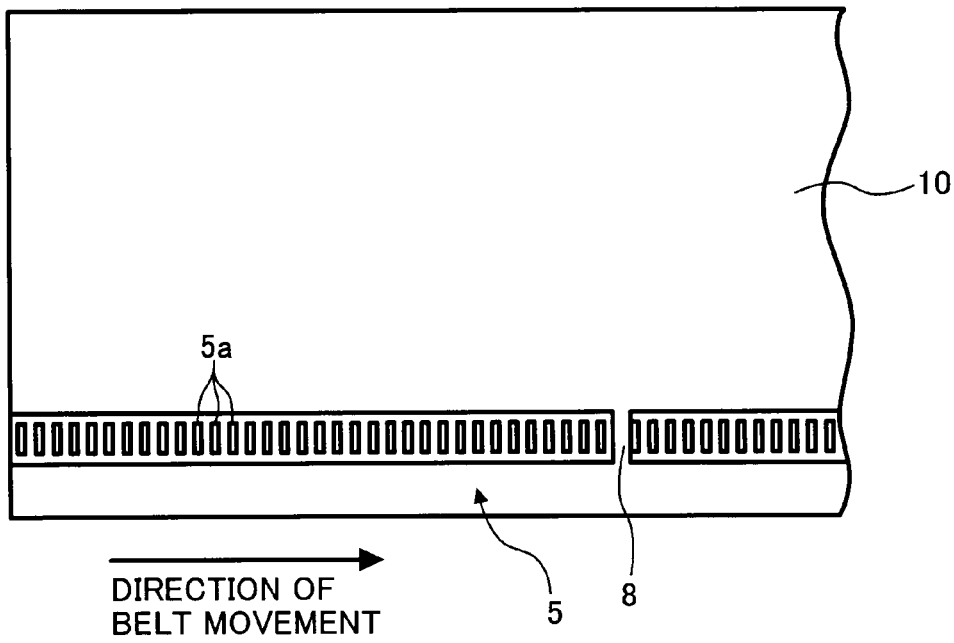
FIG. 3 is a plan view of a part of an intermediate transfer belt in which a scale for detecting a belt position is provided over the whole circumference.

As shown in FIG. 3, divisions 5*a* of the scale 5 are formed at an equal interval on the whole circumference on the inner surface (may be the outer surface) of the intermediate transfer belt 10 (only a part thereof is shown in FIG. 1). The position of the scale in the width direction of the belt is a position corresponding to the end of the photoconductor as shown in FIG. 3. The scale 5 may be formed on a part of the intermediate transfer belt 10, instead of on the whole circumference.

The set position of the sensor 6 shown in FIG. 1 may be at any position, so long as the scale 5 on the belt surface at a portion of the intermediate transfer belt 10 linearly laid across in a tensioned condition can be detected.

Figure 4:
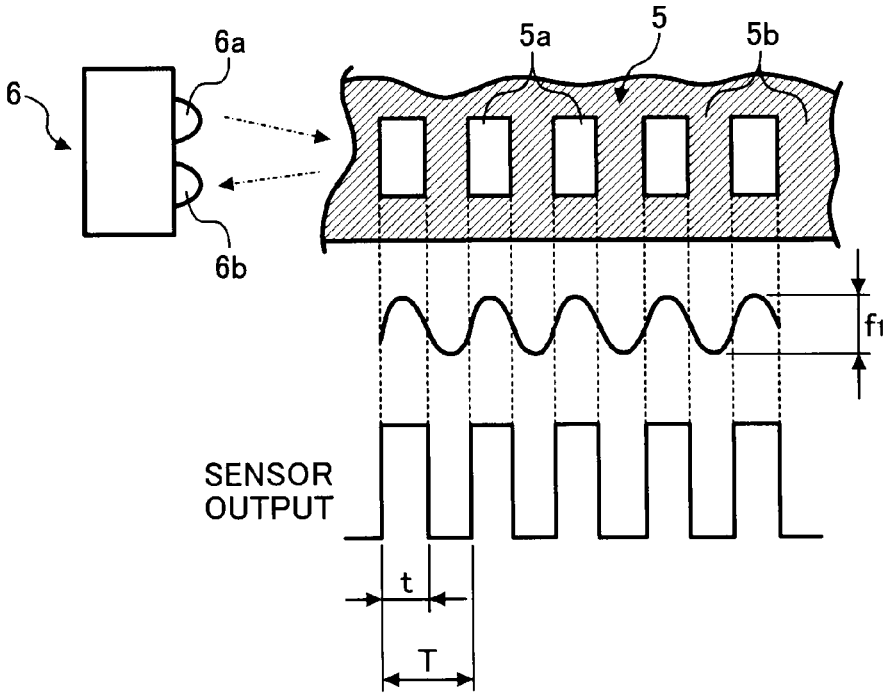
FIG. 4 is a schematic diagram of a sensor that reads the scale provided on the intermediate transfer belt and a sensor output of the sensor.

As one example of the sensor 6 is shown in FIG. 4, the sensor 6 is a reflecting type optical sensor having a pair of light emitting element 6*a* and a light receiving element 6*b*, so that the reflected light of the light irradiated from the light emitting element 6*a* toward the scale 5 is received by the light receiving element 6*b*, and at that time, a different quantity of reflected light is detected between the divisions 5*a* and other portions 5*b* of the scale 5.

In other words, the sensor 6 outputs binary signals of High and Low, according to the difference in the reflectance different between the divisions 5*a* and other portions 5*b* of the scale 5.

For example, when the type of the sensor 6 is a type of outputting the High signal when the light receiving element 6*b* receives light, and if it is formed such that the reflectance of the divisions 5*a* of the scale 5 is higher than that of the other portions 5*b*, the signal output from the sensor 6 is such that the range t in FIG. 4 shows an output while the division 5*a* is passing the sensor 6.

Therefore, with the rotation of the intermediate transfer belt 10, the output of the sensor 6 repeats High and Low as shown in FIG. 4, according to the presence of the divisions 5*a* passing through the detection range of the sensor 6.

Accordingly, by determining the cycle (time) T from a point in time when the signal has changed from Low to High until the signal changes again from Low to High next time, the moved distance (belt position) on the surface of the intermediate transfer belt 10 can be detected.

While one example of a method for detecting the belt position of the intermediate transfer belt 10 is explained, any type of the sensor and the scale may be used, and the detection method may be any detection method, so long as the belt position of the intermediate transfer belt 10 can be detected by detecting the scale formed thereon.

In the color copier shown in FIG. 2, the actual belt position of the intermediate transfer belt 10 is detected from the information of the scale 5 read by the sensor 6, and the position of the intermediate transfer belt 10 is corrected and controlled according to the actual belt position. The control therefor is performed by the controller 70 shown in FIG. 1.

The controller 70 includes a microcomputer having a central processing unit (CPU) having various determination and processing functions, a read only memory (ROM) storing various processing programs and fixed data, a random access memory (RAM) as a data memory for storing processing data, and an input/output circuit (I/O).

Figure 5:
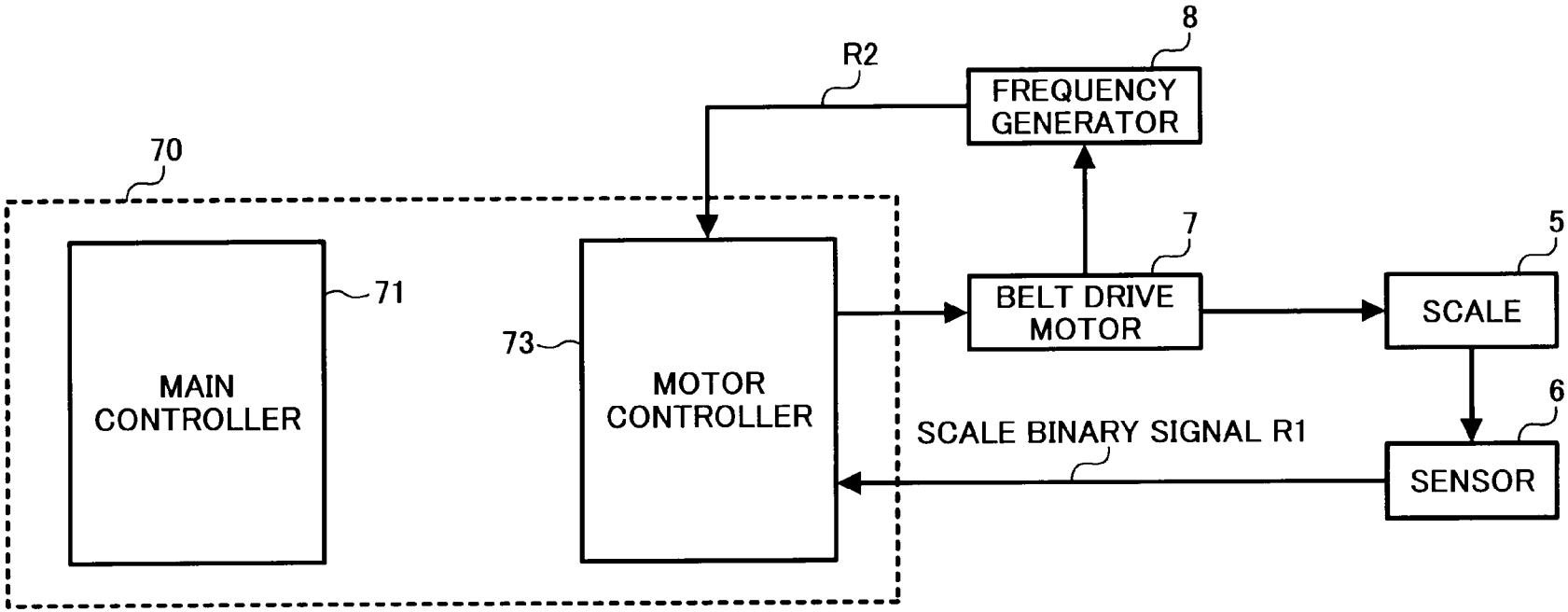
FIG. 5 is a block diagram of a position control system of the intermediate transfer belt of the color copier in FIG. 2.

The controller 70 is provided with, as shown in FIG. 5, a main controller 71 and a motor controller 73. The belt position information of the intermediate transfer belt 10 obtained by detecting the scale 5 by the sensor 6 is input to the motor controller 73, and the motor controller 73 controls the drive of the belt driving unit motor 7 that drives the intermediate transfer belt 10, according to the input information.

The normal-position control loop R1 is a control loop used in normal conditions for detecting the belt position of the intermediate transfer belt 10 from the information obtained by reading the scale 5 on the intermediate transfer belt 10 by the sensor 6, and feedback-controlling the belt driving unit motor 7 based on the information.

The abnormal-condition control loop R2 is a control loop used in abnormal conditions for feeding back a signal of a frequency generator (FG) 8 attached to the belt driving unit motor 7, and controlling the drive of the belt driving unit motor 7, thereby correcting and controlling the belt position of the intermediate transfer belt 10.

Figure 6:
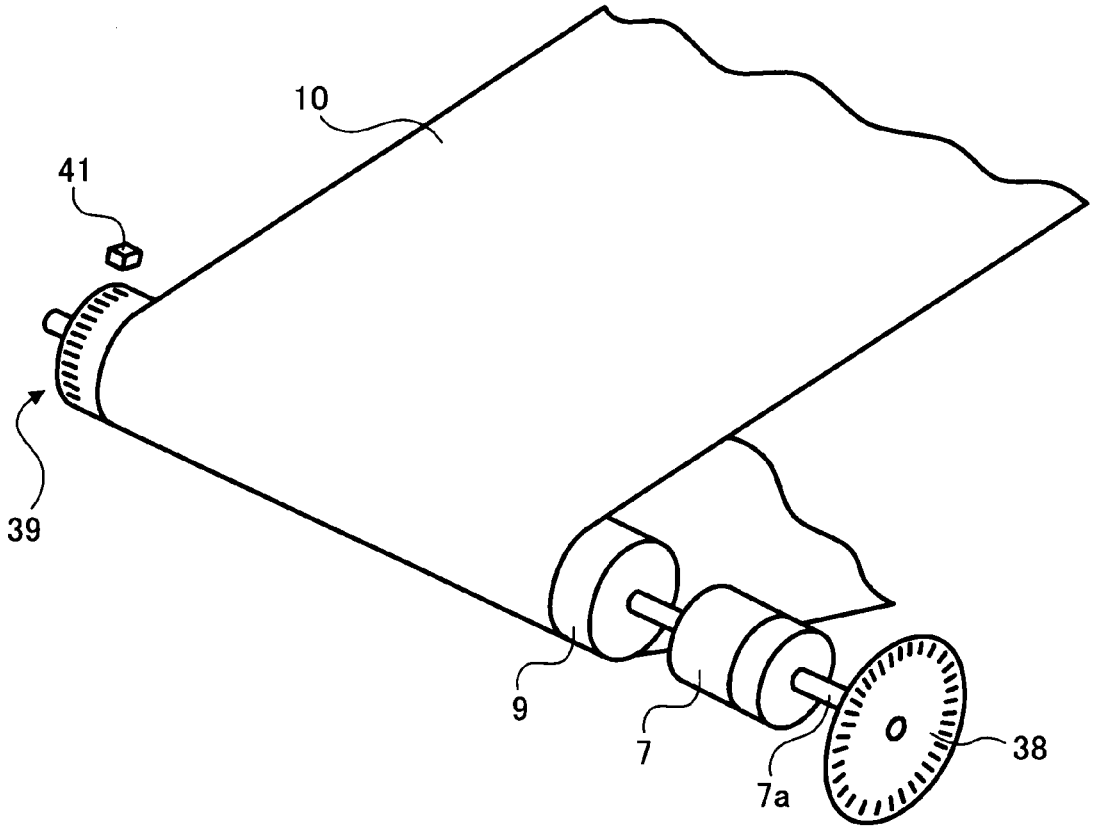
FIG. 6 is a perspective view for explaining an example in which an encoder is attached to a motor shaft of a belt driving unit and an example in which slits are formed on one end of a drive roller rotatably supporting the intermediate transfer belt.
Figure 7:
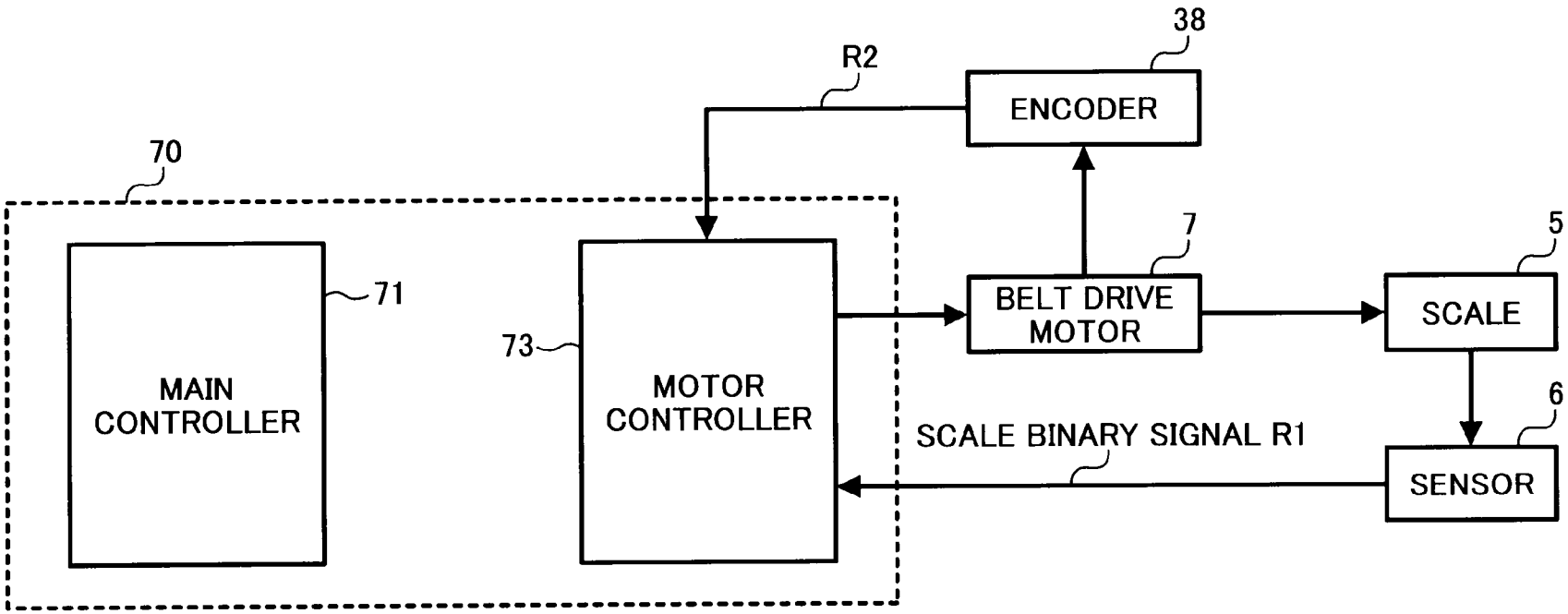
FIG. 7 is a block diagram of an example in which a signal from the encoder is fed back to a motor controller.

The abnormal-condition control loop R2 may feed back a signal from an encoder 38 attached to a motor shaft 7*a* of the belt driving unit motor 7 as shown in FIG. 6 to the motor controller 73 as shown in FIG. 7, as well as feeding back the signal of the frequency generator 8 attached to the belt driving unit motor 7 to the motor controller 73.

Figure 8:
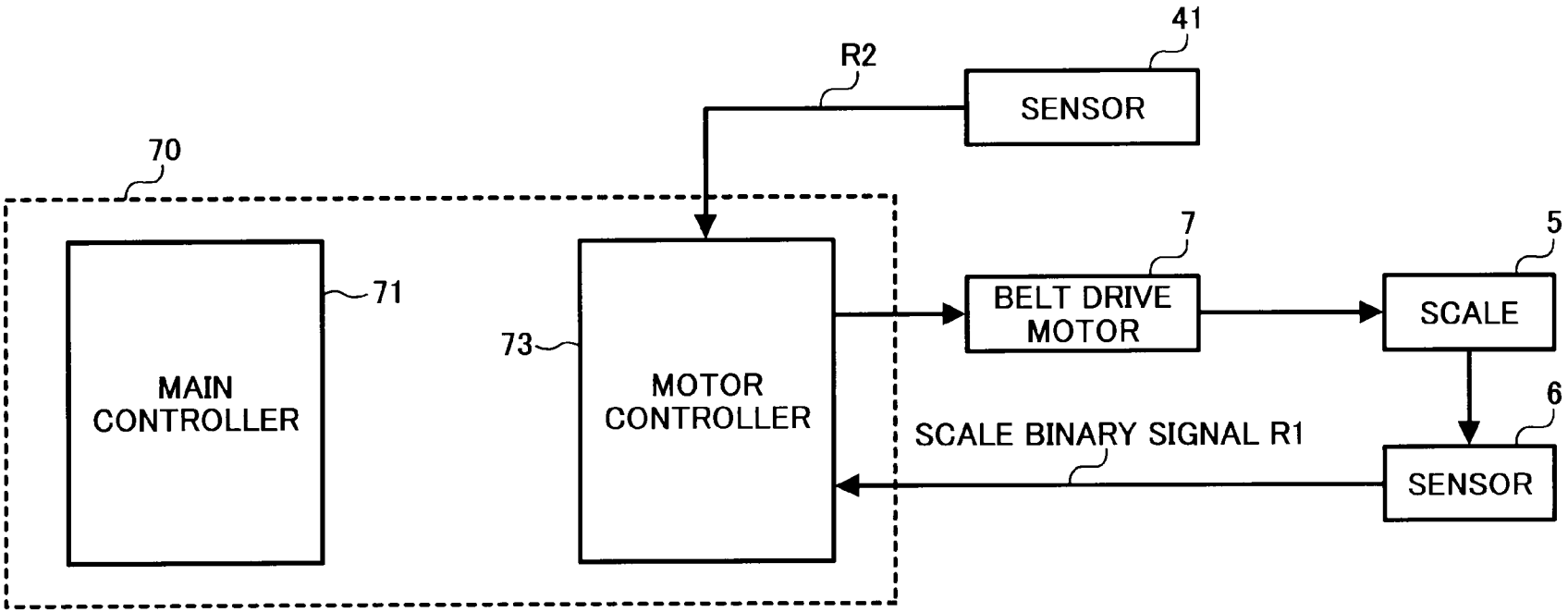
FIG. 8 is a block diagram of an example in which a signal from the sensor that detects the slit formed on one end of the drive motor in FIG. 6 is fed back to the motor controller.

Alternatively, as also shown in FIG. 6 for simplifying the illustration, slits 39 may be formed in the circumferential direction on the outer circumference of the drive roller 9 at one end, which rotatably supports the intermediate transfer belt 10, a sensor 41 for detecting the slit 39 is provided near the slits 39, and a signal from the sensor 41 may be fed back to the motor controller 73 as shown in FIG. 8.

Figure 9:
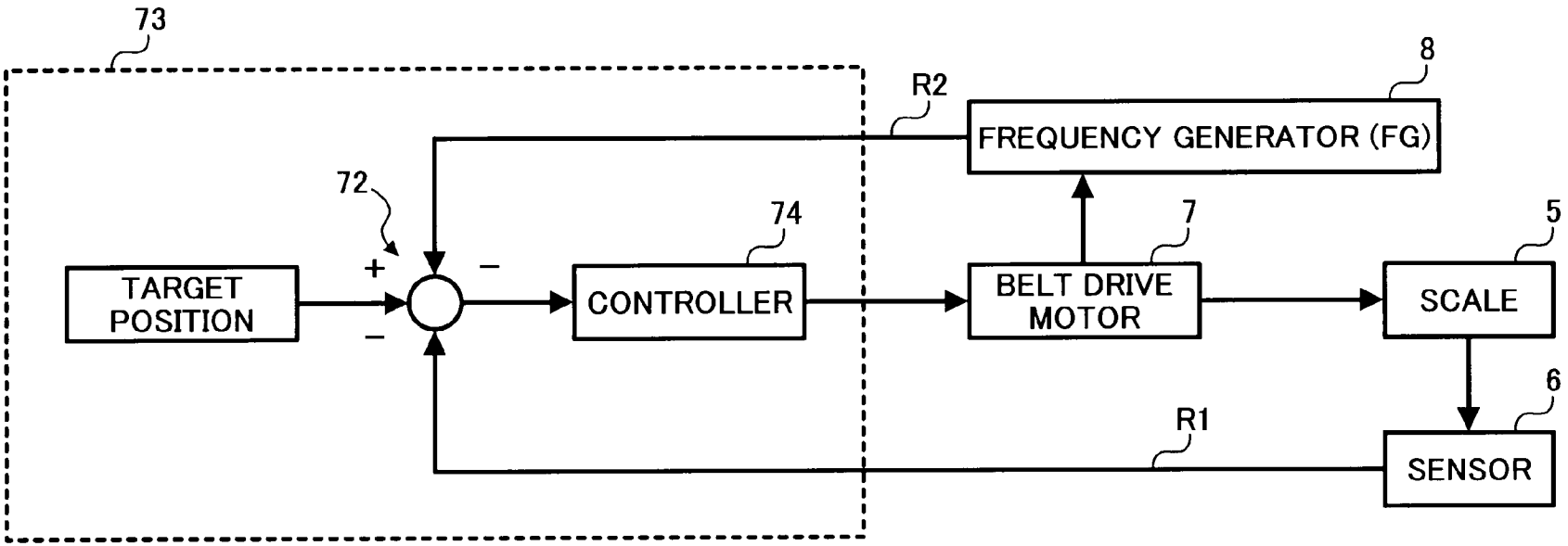
FIG. 9 is a block diagram for explaining two feedback loops included in the color copier in FIG. 2.

The normal-position control loop R1 and the abnormal-condition control loop R2 will be explained in detail, with reference to FIG. 9.

The motor controller 73 inputs a preset target count value corresponding to a target position of the intermediate transfer belt 10 to a calculator 72, to control the drive of the belt driving unit motor 7 via the controller 74 so that the intermediate transfer belt 10 comes to the target position.

As a result, the intermediate transfer belt 10 starts rotation, and the scale 5 provided over the whole circumference on the inner surface of the belt moves with the rotation of the intermediate transfer belt 10. The sensor 6 reads the scale 5, and feeds back the read pulse count value to the calculator 72 in the motor controller 73.

The calculator 72 compares the target count value (corresponding to the target position) with the fed back pulse count value (corresponding to the actual belt position), and when these values match with each other, the calculator 72 controls the drive of the belt driving unit motor 7 so as to maintain the current target position by outputting a signal for driving the belt driving unit motor 7 to the controller 74. When there is a position difference, which requires correction, between the belt position obtained by feedback and the target position, the calculator 72 outputs a signal for controlling the number of revolution of the belt driving unit motor 7 corresponding to the position difference to the controller 74, to correct the belt position.

The correction of the belt position will be explained later in detail.

The information (signal) obtained by reading the scale 5 by the sensor 6 is input to the motor controller 73. The signal input to the motor controller 73 is a binarized pulse signal as shown in FIGS. 4 and 5.

The motor controller 73 compares the pulse count value (frequency) counted within a preset prescribed time with a target count value (frequency indicating a cumulative position since start-up of the motor), and controls the feedback quantity provided to the belt driving unit motor 7 according to the difference.

If the belt position of the intermediate transfer belt 10 is constant, an analog signal (a signal of an amplitude $f_1$ shown in FIG. 4) output by the sensor 6 that has detected the scale 5 on the intermediate transfer belt 10 becomes constant, and the pulse signal obtained by binarizing the analog signal becomes constant as well. Therefore, in this case, the frequency is constant.

Figure 10:
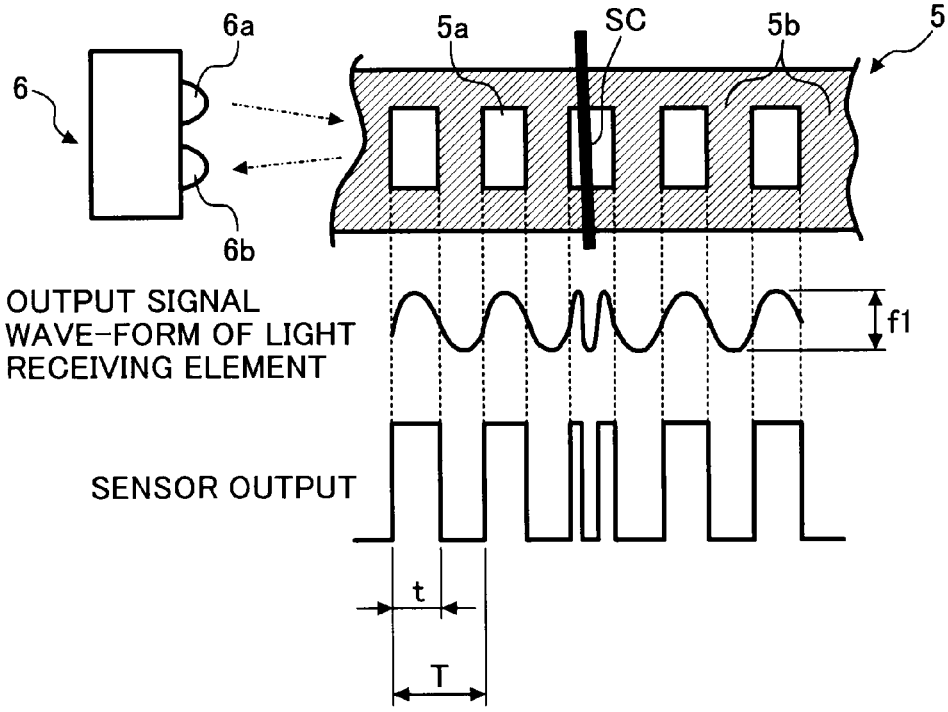
FIG. 10 is a diagram for explaining the sensor output when one division of the scale is damaged.
Figure 11:
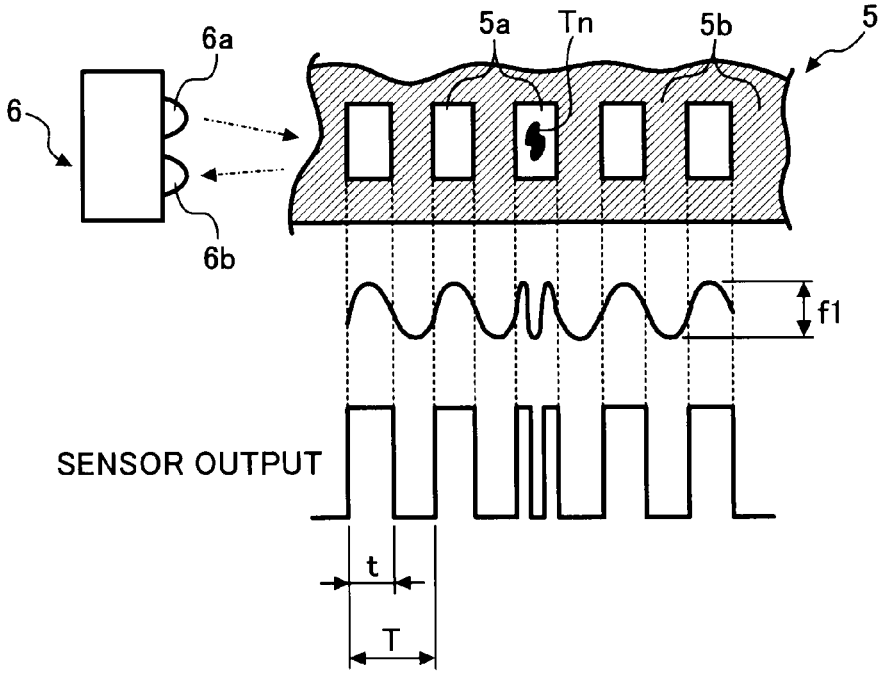
FIG. 11 is a diagram for explaining the sensor output when one division of the scale is stained by a toner.

However, for example, when a division 5*a* of the scale 5 receives a scratch SC as shown in FIG. 10, or a toner Tn adheres on a division 5*a* as shown in FIG. 11, thereby deteriorating the scale 5, the frequency becomes outside the prescribed frequency (pulse count value).

Therefore, in the color copier according to this embodiment, when the signal output by the sensor 6, which has detected deterioration of the scale 6, is input to the motor controller 73, and when the frequency (state) of deterioration exceeds a preset frequency (determined for each type by experiments or the like), the control loop to be used is switched from the normal-position control loop R1 to the abnormal-condition control loop R2.

The normal position control processing of the intermediate transfer belt 10 performed by the microcomputer included in the controller 70 will be explained with reference to FIG. 12.

Figure 12A:
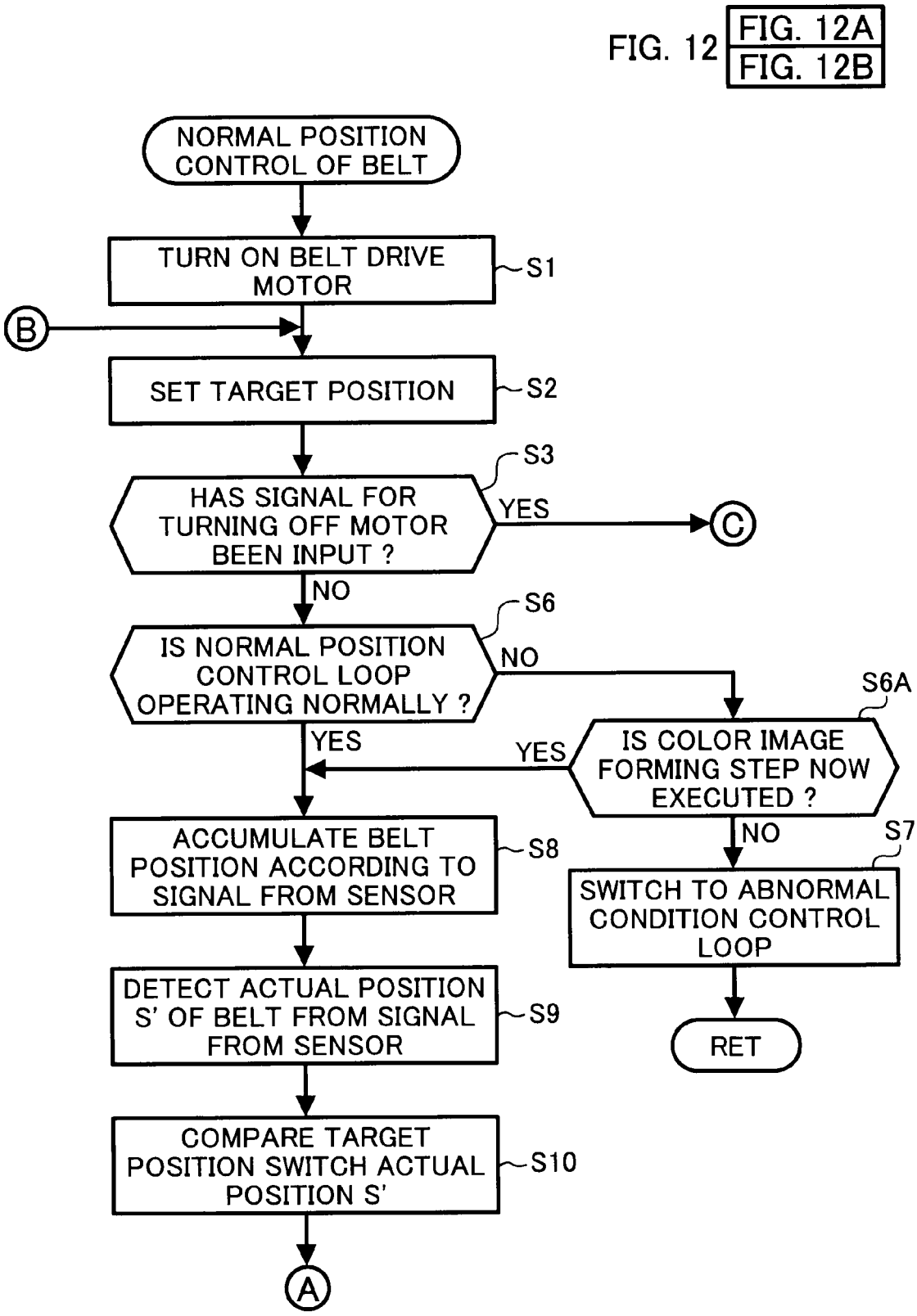
FIG. 12 is a flowchart of a routine relating to a normal position control processing of the intermediate transfer belt performed by a microcomputer in a controller included in the belt driving unit in FIG. 1.
Figure 12B:
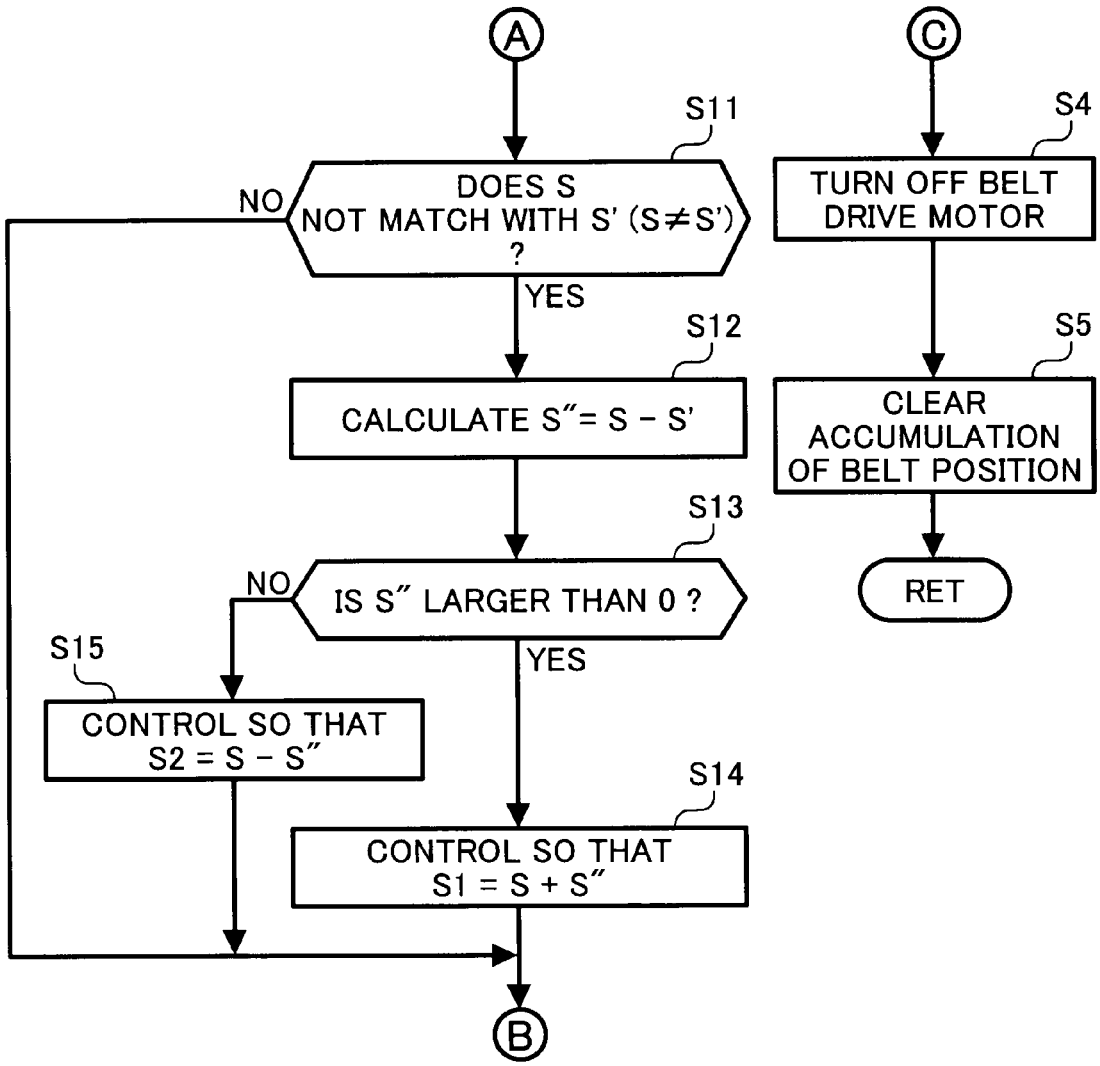

The microcomputer included in the controller 70 shown in FIG. 1 initiates a routine shown in FIG. 12 at a predetermined timing.

First at step 1, the belt driving unit motor 7 is turned on and the target position is set at step 2. As a result, the intermediate transfer belt 10 is rotated so as to be at the target position (controlled by the motor controller 73 in FIG. 9).

At step 3, it is determined whether a signal for turning off the belt driving unit motor 7 has been input, and when the OFF signal has been input, control proceeds to step 4, to turn off the belt driving unit motor 7, and at step 5, accumulation of the belt position is cleared, and the processing is finished to return to the main routine.

According to the determination at step 3, when the OFF signal has not been input and control proceeds to step 6, it is determined whether the normal-position control loop R1 is normally operating. When the normal-position control loop R1 is not normally operating, control proceeds to step 6A.

At step 6A, it is determined whether the color image forming step is now being executed, and when the color image forming step is now being executed, control proceeds to step 8. When the color image forming step is not being executed, control proceeds to step 7, to switch the control loop to the abnormal-condition control loop R2, in which correction control of the belt position of the intermediate transfer belt 10 is performed based on the signal from the frequency generator (FG) 8 attached to the belt driving unit motor 9, and then control returns to the main routine.

According to the determination at step 6, when the normal-position control loop R1 is normally operating and control proceeds to step 8, or since the color image forming step is now being executed according to the determination at step 6A, control proceeds to step 8, a signal fed back from the sensor 6 is input, to accumulate the position of the belt, thereby determining the target position S.

At step 9, the actual position S' on the surface of the intermediate transfer belt 10 is detected from the signal of the sensor 6. At step 10, the target position S and the actual position S' are compared.

At step 11, it is determined whether the target position S does not match with the actual position S' (S≠S'), and when S and S' are the same and there is no position difference therebetween (there is only an allowable position difference), it can be determined that the belt surface of the intermediate transfer belt 10 is rotating at the same position as the target position S. Accordingly, control is continued at the target position S, and returns to step 2, to repeat the processing and determination from step 2 onward.

According to the determination at step 11, when the target position S does not match with the actual position S' (Yes), control proceeds to step 12, to calculate a position difference S" on the belt surface between the target position S and the actual position S' of the intermediate transfer belt 10.

At step 13, it is determined whether the position difference S" is larger than zero, and when S" is larger than 0 (Determined as Yes), it can be determined that the actual position S' of the intermediate transfer belt 10 is behind the target position S. Therefore, control proceeds to step 14, to control the number of revolution of the belt driving unit motor 7 so that the belt position becomes a position S1 determined by adding the position difference S" to the target position S, and control returns to step 2.

According to the determination at step 13, when the position difference S" is not larger than zero (No), it can be determined that the position difference S" is smaller than zero, and the belt surface position of the actual position S' of the intermediate transfer belt 10 is ahead of the target position S. Therefore, control proceeds to step 14, to control the number of revolution of the belt driving unit motor 7 so that the belt position becomes a position S2 determined by subtracting the position difference S" from the target position (reference position) S, and control returns to step 2.

By repeating the processing and determination from step 2 onward, the actual position S' on the surface of the intermediate transfer belt 10 is corrected so as to be the target position S.

At step 3, when it is determined that the signal for turning off the belt driving unit motor 7 has been input, control proceeds to step 4, to turn off the belt driving unit motor 7, and at step 5, accumulation of the belt position is cleared, and the processing is finished to return to the main routine.

The color image forming step at step 6A in FIG. 12 is a step of forming an image by using two or more photoconductors 40, and steps other than the color image forming step, in the case of NO determination at step 6A and proceeding to step 7 stands for steps of forming a monochrome image, and forming the respective single color images of yellow, cyan, and magenta by using only one photoconductor 40.

When image formation is performed by using only one photoconductor 40, switching of the control loop can be performed at any timing. In other words, switching of the control loop can be performed even during image formation.

Determination whether the color image forming step is now being executed is performed based on a signal input from the CPU in the image forming apparatus, when a user specifies "color" or "monochrome" by using an operation panel.

In this color image forming apparatus, as shown in FIG. 2, the ADF 4 is provided, and when a plurality of document is read by using the ADF 4, the CPU in the image forming apparatus determines whether the read document is a color image, upon completion of read, and the linear velocity for image formation is changed according to the determination result. Accordingly, it may be determined whether the color image forming step is now being executed, from the linear velocity condition transmitted from the CPU to the motor controller 73 (see FIG. 5 and the like).

The scale 5 provided on the intermediate transfer belt 10 may be provided inside or outside of the belt.

As in this embodiment, the advantage of providing the scale 5 inside of the belt is that the scale 5 is unlikely to be stained, and foreign objects are unlikely to adhere thereon. Further, the scale 5 is unlikely to be damaged, or since the sensor 6 that reads the scale 5 is arranged inside of the belt, the sensor 6 is unlikely to be stained.

On the other hand, the disadvantage of providing the scale 5 inside of the belt is that a large sensor cannot be used as the sensor 6, and there is a limitation on the direction and distance for arranging the sensor.

On the contrary, the advantage of providing the scale 5 outside of the belt is that there is little limitation on the arrangement of the sensor 6 for reading the scale 5. On the other hand, there are disadvantages in that the scale 5 is likely to be stained or damaged, and foreign objects are likely to adhere thereon.

In the belt driving unit 20 in this embodiment, the scale is provided inside of the intermediate transfer belt 10 as shown in FIG. 1. However, the divisions 5*a* receive fine scratches or foreign objects such as toner adhere thereon (see FIGS. 3 and 4) with the lapse of time, whereby the scale becomes dirty and the reflectance on the reflecting surface decreases. In such a state, the frequency of pulses output by the sensor 6 that has detected the divisions 5*a* tends to be abnormal.

If the belt position of the intermediate transfer belt 10 is controlled to be constant, the frequency of the pulse signal output by the sensor 6 that has read the scale 5 on the intermediate transfer belt 10 becomes constant. That is, the count value of the pulse signal counted within a preset prescribed time becomes constant.

However, as shown in FIG. 10, when a division 5*a* of the scale 5 receives a scratch SC as shown in FIG. 10, or a mass of toner Tn adheres on a part of a division 5*a* as shown in FIG. 11, thereby deteriorating the scale 5, a part of the analog output signal which should be output regularly from the sensor 6 with an amplitude $f_1$ as shown in the figure, is not output.

Further, there may be two pulses where there is essentially only one pulse. In this state, the frequency in the output of the binarized digital signal (pulse) changes, to become an abnormal state, different from the reference frequency (a frequency when there is no scratch and stain).

When such an abnormal state occurs in the frequency, since the motor controller 73 in the controller 70 shown in FIG. 5 normally controls the belt driving unit motor 7 based on the binarized pulse signal, the motor controller 73 cannot drive the belt driving unit motor 7 at a constant rate. As a result, since the position of the intermediate transfer belt 10 cannot be corrected to the accurate belt position, out of color registration or the like occurs when a color image is formed.

However, in the belt driving unit 20 according to this embodiment and the color copier including the belt driving unit 20, the controller 70 shown in FIG. 1 determines the deteriorated state of the divisions 5*a* (FIGS. 3 and 4) of the scale 5 according to the signal from the sensor 6, and when it is determined that the division has deteriorated, and when the number of deterioration exceeds a frequency (a frequency being a preset threshold), or it is determined to be abnormal deterioration, the controller 70 switches the control loop from the normal-position control loop R1 to the abnormal-condition control loop R2.

In other words, the controller 70 determines deterioration (scratches, stains, or wear) of the scale 5 by comparing the frequency (count value of a pulse) of the output value output by the sensor 6 that has read the scale 5 with a preset reference frequency. The frequency (which may be a state) of deterioration is compared with a prescribed value, and when it is determined to be abnormal deterioration, the controller 70 switches the control loop from the normal-position control loop R1 to the abnormal-condition control loop R2.

Figure 13:
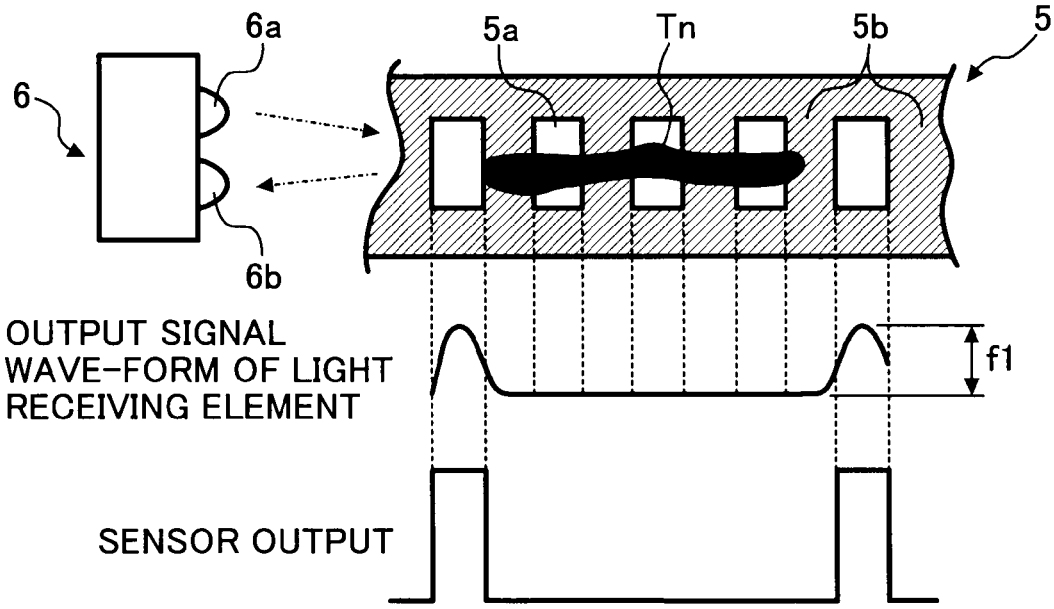
FIG. 13 is a diagram for explaining an abnormally deteriorated state of the scale.

The abnormal deterioration state described above is, for example as shown in FIG. 13, when a stain such as toner Tn adheres over a plurality of divisions 5*a* of the scale 5 for long time, thereby prolonging the output (pulse) interval of the sensor 6 than a preset predetermined time as shown in the figure. When two sensors that detect the scale 5 are provided as described below, the abnormal deterioration state stands for an instance in which a difference in pulse between the two sensors (see $\alpha$ in FIG. 16) is compared with a prescribed value, and the difference is large.

Figure 14A:
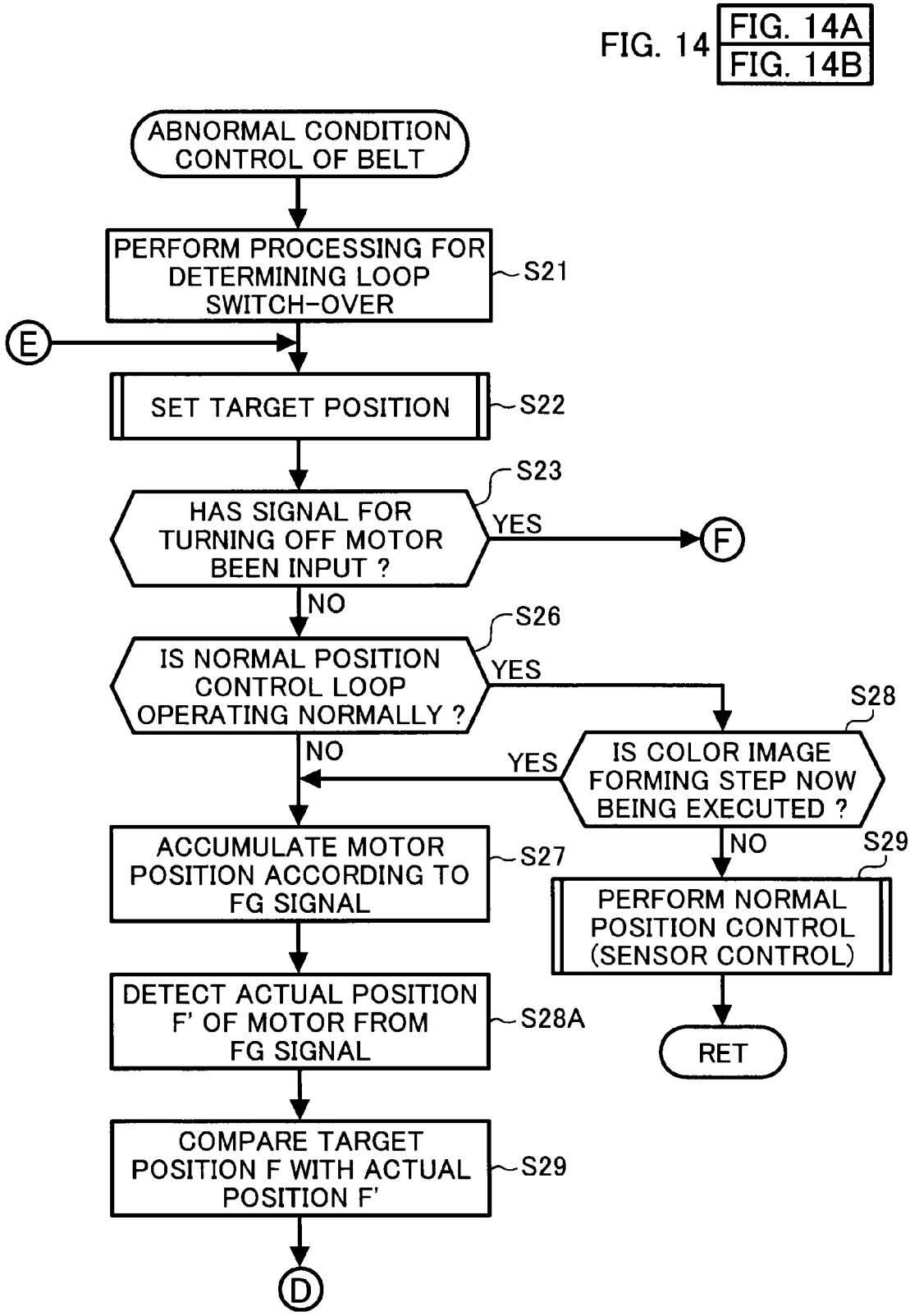
FIG. 14 is a flowchart of a routine relating to the control processing in abnormal conditions of the intermediate transfer belt, performed by the microcomputer in the controller included in the belt driving unit in FIG. 1.
Figure 14B:
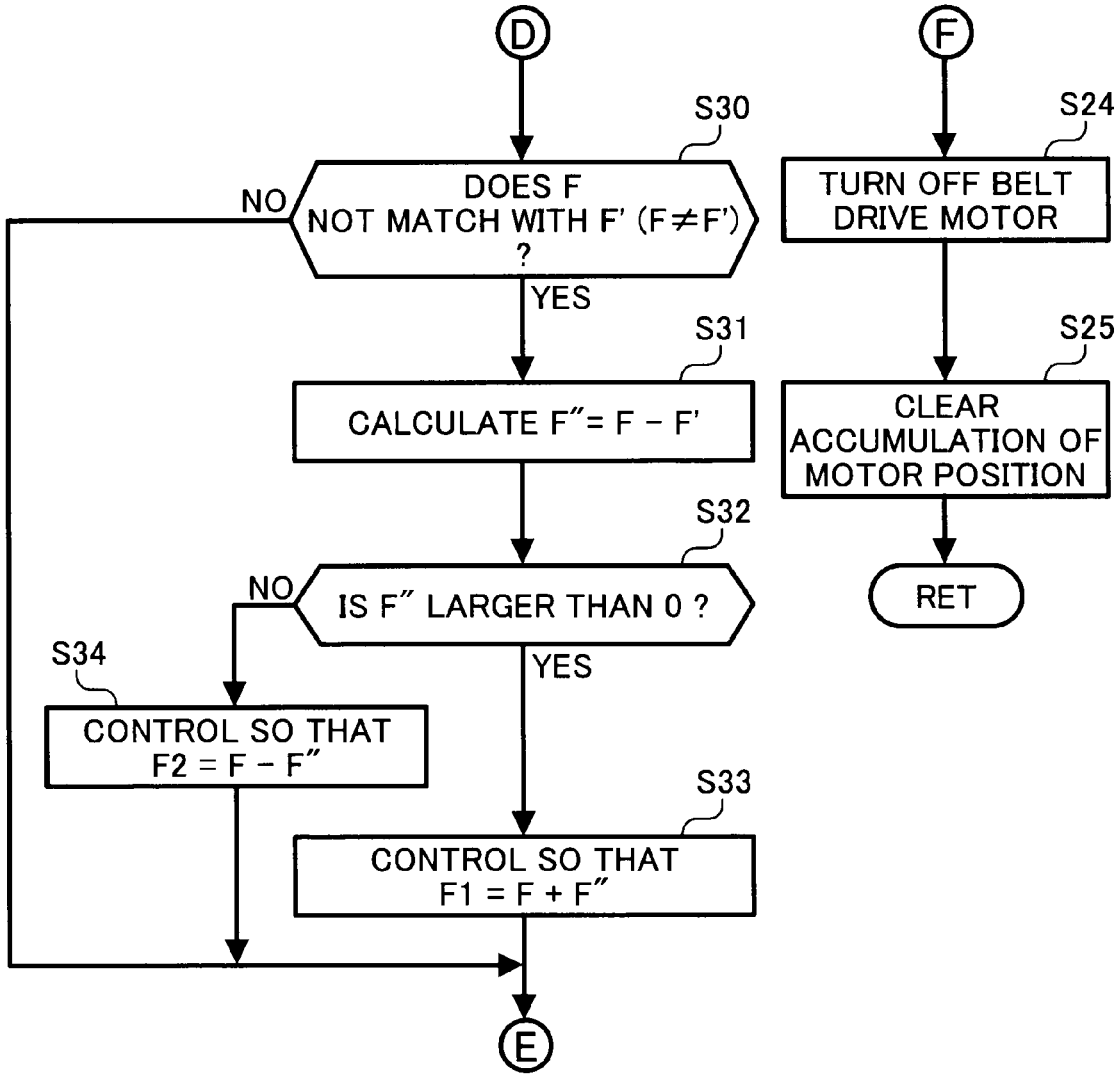

FIG. 14 is a flowchart of a routine relating to the control processing in abnormal conditions of the intermediate transfer belt.

The microcomputer included in the controller 70 shown in FIG. 1 initiates the routine shown in FIG. 14 at a predetermined timing.

At step 21, processing for determining switchover of the control loop, that is, processing for switching the control loop from the normal-position control loop R1 to the abnormal-condition control loop R2 is performed only at a timing other than that of the image forming step of a color image.

This is because when the control loop to be used is switched from the normal-position control loop R1 to the abnormal-condition control loop R2, the detection signal to be used for the control is switched from the signal obtained by detecting the scale 5 by the sensor 6 to the signal of the frequency generator 8 (FG signal) of the belt driving unit motor 7, there is the possibility that a position change may occur in the intermediate transfer belt 10 at the moment when the signal is switched.

At step 22, a target position is set. As a result, the intermediate transfer belt 10 is rotated so as to be at the target position.

At steps 23 to 26, the same determination and processing as those of at steps 3 to 6 explained with reference to FIG. 12 are performed (however, at step 25, accumulation of motor position is cleared).

As the determination at step 26, it is determined whether the normal-position control loop R1 is normally operating, and if the normal-position control loop R1 is not normally operating, control proceeds to step 27. However, if the normal-position control loop R1 is normally operating, control proceeds to step 28.

At step 28, it is determined whether the color image forming step is now being executed. When the color image forming step is now being executed, control proceeds to step 27, but when the color image forming step is not being executed, control proceeds to step 29, to detect the scale 5. The belt position is then corrected in the normal-position control loop R1 in which feedback control is performed by using the signal output by the sensor 6 by detecting the scale 5, to return to the main routine.

According to the determination at step 26, when the normal-position control loop R1 is not normally operating, and control proceeds to step 27, or according to the determination at step 28, control proceeds to step 27, since the color image forming step is now being executed, the FG signal fed back from the frequency generator (FG) 8 attached to the belt driving unit motor 7 is input, the position of the motor is accumulated from the FG signal, and at step 28A, the actual position F' of the belt driving unit motor 7 is detected from the FG signal.

At step 29, the target position F and the actual position F' of the belt driving unit motor 7 are compared. At step 30, it is determined whether the target position F and the actual position F' are not the same ($F \neq F'$). If these positions are the same and there is no position difference between these (there is only an allowable position difference), it can be determined that the belt driving unit motor shaft of the belt driving unit motor 7 is rotating at the same position as the target position F. Therefore, control is continued at the target position F, and control returns to step 22, where the processing and determination from step 22 onward are repeated.

According to the determination at step 30, when the target position F and the actual position F' are not the same (Yes), control proceeds to step 31, where a position difference F" between the target position F and the actual position F' of the belt driving unit motor 7 is calculated.

At step 32, it is determined whether the position difference F" is larger than zero, and when $F''>0$ (Determined as Yes), it can be determined that the actual position F' of the belt driving unit motor 7 is behind the target position F. Therefore, control proceeds to step 33, to control the number of revolution of the belt driving unit motor 7 so that the belt driving unit motor 7 comes to a position F1 obtained by adding the position difference F" to the target position F, and control returns to step 22.

According to the determination at step 32, when the position difference F" is not larger than zero (Determined as No), it can be determined that the position difference F" is smaller than zero and the actual position F' of the belt driving unit motor 7 is ahead of the target position F. Therefore, control proceeds to step 34, to control the number of revolution of the belt driving unit motor 7 so that the belt driving unit motor 7 comes to a position F2 obtained by subtracting the position difference F" from the target position (reference position) F, and control returns to step 22.

By repeating the processing and determination from step 22 onward, the actual position F' of the belt driving unit motor 7 is corrected and controlled so as to be the target position F. At step 23, when it is determined that the signal for turning off the belt driving unit motor 7 has been input, control proceeds to step 24, to turn off the belt driving unit motor 7, and at step 25, accumulation of the motor position is cleared, and the processing is finished to return to the main routine.

In this embodiment, switching from the normal-position control loop R1 to the abnormal-condition control loop R2, and switching from the abnormal-condition control loop R2 to the normal-position control loop R1 are not performed during the color image forming step, and the switchover timing of the control loop is a timing other than that of the color image forming step.

When a synthesized color image is obtained by superposing toner images of two or more colors, the detection signal to be used for the control is a signal from the scale 5 in the case of the normal-position control loop R1, but in the case of the abnormal-condition control loop R2, the detection signal to be used for the control is a signal from the frequency generator 8 of the belt driving unit motor 7, different from the scale 5. Therefore, at the timing when switching the control loop, a position change occurs in the intermediate transfer belt 10, and out of color registration is likely to occur in the image transferred onto the intermediate transfer belt 10. However, by setting the switchover timing of the control loop as described above, a color image without out of color registration can be obtained.

This control is performed by the controller 70 shown in FIG. 1. In other words, in this embodiment, the controller 70 functions as a loop-switchover timing controller.

The controller 70 also controls such that when abnormality occurs in the normal-position control loop R1, and after switching the control loop to the abnormal-condition control loop R2, when the normal-position control loop R1 having abnormality returns to the normal state, the control loop is switched again from the abnormal-condition control loop R2 to the normal-position control loop R1, at a timing other than that of the color image forming step.

Further, the controller 70 also functions as a unit that performs switchover from the normal-position control loop R1 to the abnormal-condition control loop R2, and from the abnormal-condition control loop R2 to the normal-position control loop R1 even during the image formation, at the time of forming a single color image.

In this embodiment, switchover of the control loop between the normal-position control loop R1 and the abnormal-condition control loop R2 is performed even during the image formation, at the time of forming a single color image. At the time of forming a single color image (for example, a time of forming a black image), only one color (monochrome) image is transferred onto the intermediate transfer belt 10, and a superposed synthesized image is not formed, and hence there is no need to worry about out of color registration. Consequently, at the time of forming a monochrome image, when abnormality on the scale is detected, the control loop is immediately switched to the abnormal-condition control loop R2.

In the image forming apparatus according to this embodiment, switchover from the normal-position control loop R1 to the abnormal-condition control loop R2 is performed basically when abnormality is detected in the normal-position control loop R1. However, when the image forming apparatus is turned on, if abnormality is detected in the normal-position control loop R1, the abnormal-condition control loop R2 is used immediately after start-up of the belt driving unit motor 7, without using the normal-position control loop R1. In other words, according to the deterioration of the scale 5 on the intermediate transfer belt 10, the control loop may not be switched from the normal-position control loop R1 to the abnormal-condition control loop R2.

Figure 15:
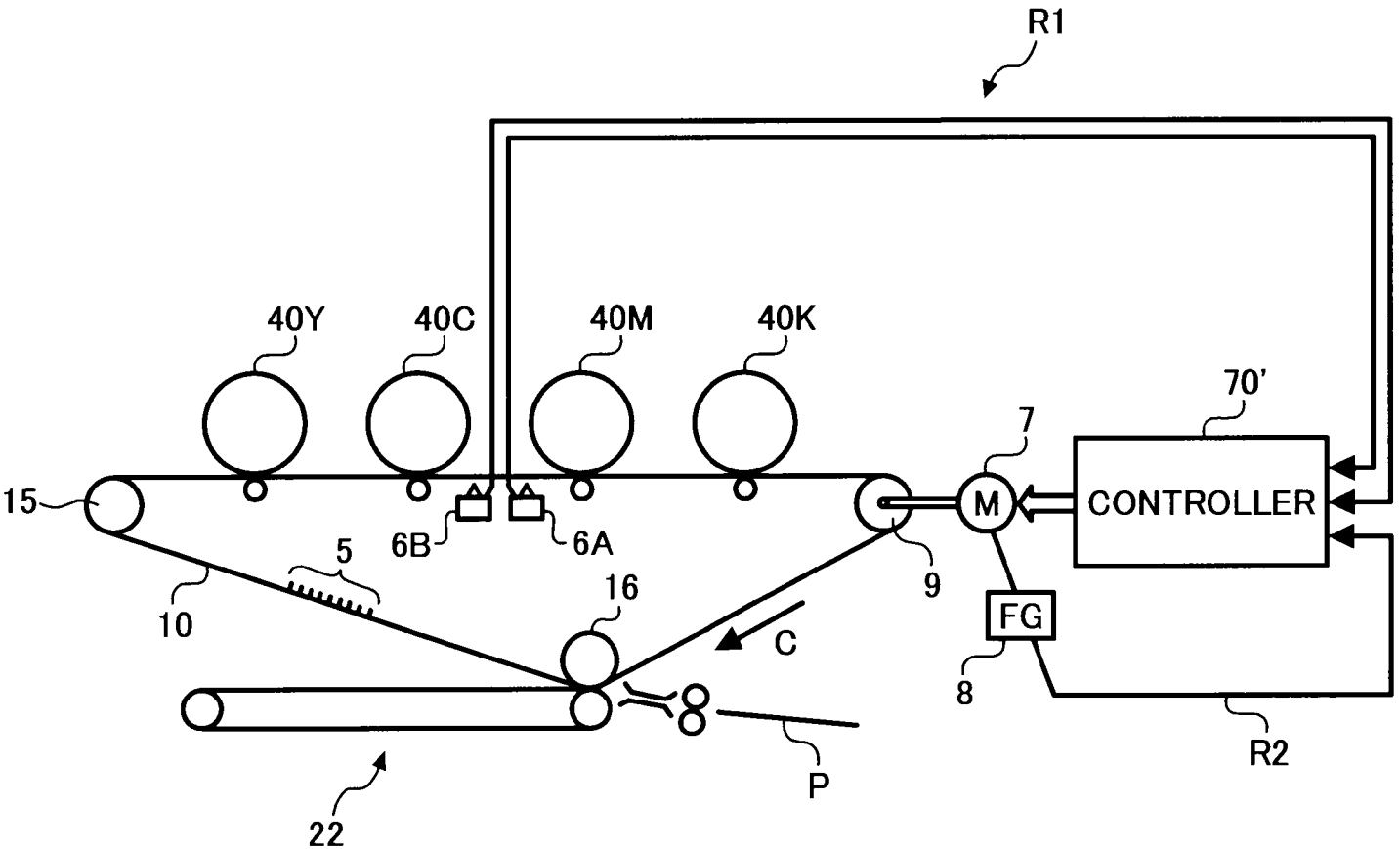
FIG. 15 is a schematic block diagram same as that of FIG. 1, depicting an embodiment of the belt driving unit in which two sensors that read the scale formed on the intermediate transfer belt are provided.
Figure 16:
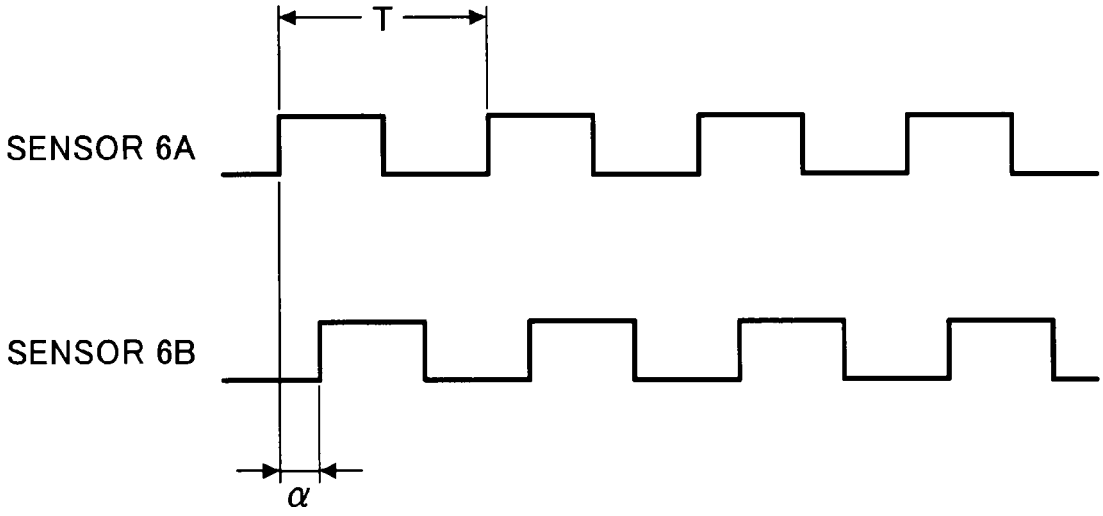
FIG. 16 is a waveform diagram of an output waveform of the two sensors.
Figure 17:
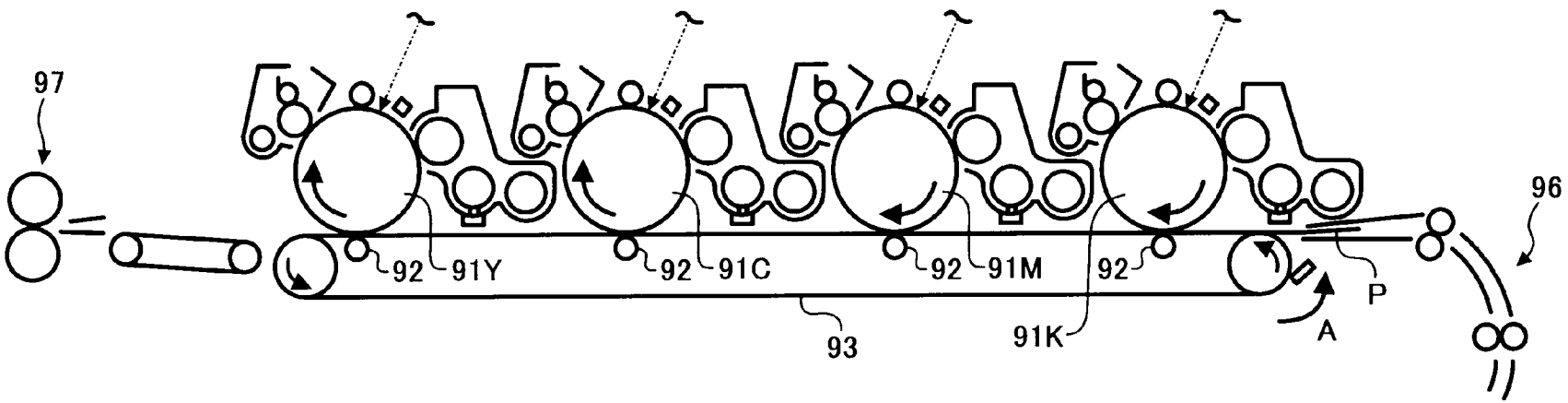
FIG. 17 is a block diagram depicting only an image forming unit in an example of a conventional image forming apparatus of direct transfer type.
Figure 18:
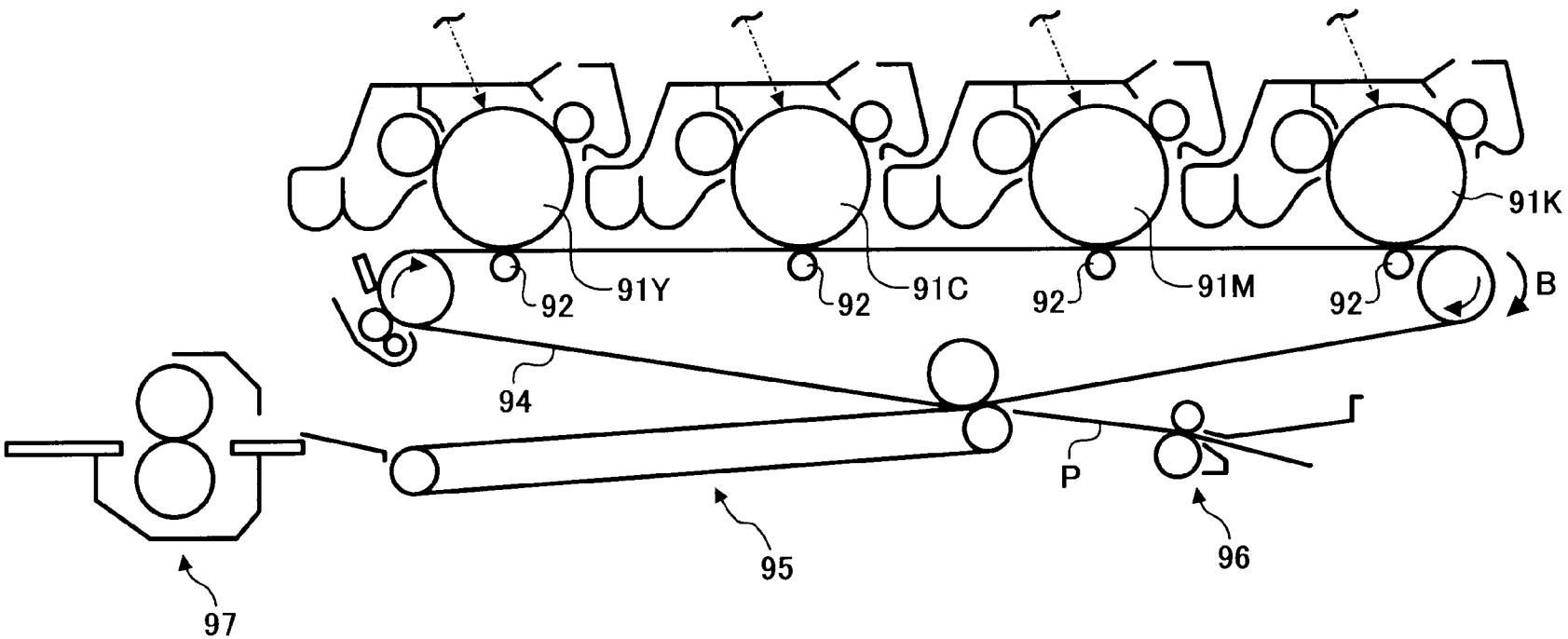
FIG. 18 is a block diagram depicting only the image forming unit in an example of a conventional image forming apparatus of indirect transfer type.

FIG. 15 is a schematic block diagram same as that of FIG. 1, depicting an embodiment of the belt driving unit in which two sensors that read the scale formed on the intermediate transfer belt are provided. FIG. 16 is a waveform diagram of an output waveform of the two sensors, and like reference signs designate like parts in FIG. 1.

In the image forming apparatus including the belt driving unit according to this embodiment, sensors 6A and 6B are arranged between the photoconductors 40C and 40M (may be other photoconductors 40) in the traveling direction of the intermediate transfer belt 10, with the position being shifted from each other. The sensors 6A and 6B are sensors of the same type and having the same performance. Therefore, the output waveform output from the sensors 6A and 6B, which have detected the scale 5 on the intermediate transfer belt 10, are as shown in FIG. 16.

In this embodiment, the controller 70' controls the belt speed of the intermediate transfer belt 10 such that a difference $\alpha$ in pulses output from the sensors 6A and 6B becomes constant, so that the actual belt speed of the intermediate transfer belt 10 becomes constant.

Thus, as the drive control of the intermediate transfer belt 10, not only the belt position of the intermediate transfer belt 10 is corrected as explained with reference to FIG. 1 and the like, but also the actual belt speed of the intermediate transfer belt 10 may be detected so as to perform correction control to make a speed change constant.

In FIG. 15, an example is shown in which in the abnormal-condition control loop R2, a signal from the frequency generator 8 attached to the belt driving unit motor 7 is fed back to the controller 70' (more specifically, to the motor controller). However, in the abnormal-condition control loop R2, as explained in FIG. 6, the encoder 38 may be attached to the motor shaft 7*a* of the belt driving unit motor 7, and the signal from the encoder 38 may be fed back to the motor controller in the controller 70'.

Alternatively, as described with reference to FIG. 6, slits 39 may be formed in the circumferential direction on the outer circumference of the drive roller 9 at one end, which rotatably supports the intermediate transfer belt 10, a sensor 41 for detecting the slit 39 is provided near the slits 39, and a signal from the sensor 41 may be fed back to the motor controller in the controller 70'.

According to the present invention, when the scale on the belt is worn out or damaged, or is stained and deteriorates due to adhered toner or the like, the control loop to be used is switched from the normal-position control loop to the abnormal-condition control loop, to control the drive of the belt. Accordingly, an accurate belt position of the belt or an accurate belt speed is maintained.

Since the timing for switching the control loop can be controlled, switchover of the control loop during the image forming step is prevented. As a result, even when a color image of two or more colors is formed, out of color registration can be avoided.

Further, when the loop-switchover timing controller is a unit that performs switchover of the control loop even during image formation, at the time of forming a monochrome image, the loop-switchover timing controller performs switchover of the control loop immediately even during image formation, when a color image is not being formed, that is, when a monochrome image is being formed. As a result, switchover to a control corresponding to abnormal conditions can be quickly performed.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A belt driving unit comprising:

a rotary belt on which a scale is formed;

a sensor that reads the scale;

a determining means for determining whether a color image or monochrome image is being formed;

a normal-position control loop that detects an actual position of the rotary belt based on information of the scale read by the sensor, and corrects a position of the rotary belt based on the actual belt position detected;

an abnormal-condition control loop for a situation when an abnormality occurs in the normal-position control loop; and a loop-switchover timing controller that controls a switchover timing of a control loop between the normal-position control loop and the abnormal-condition control loop, wherein, when an abnormality occurs, the switchover timing is based on whether a color image or monochrome image is being formed.

2. The belt driving unit according to claim 1, further comprising: a motor that rotates the rotary belt, wherein the abnormal-condition control loop controls driving of the rotary belt based on a signal from a frequency generator of the motor.

3. The belt driving unit according to claim 1, further comprising:

a motor that rotates the rotary belt; and an encoder that is attached to a shaft of the motor, wherein the abnormal-condition control loop controls the drive of the rotary belt based on a signal from the encoder.

4. The belt driving unit according to claim 1, wherein the abnormal-condition control loop includes a slit formed on a circumferential direction on an outer circumference of rollers that rotatably support the rotary belt; and a sensing unit arranged near the slit, and the abnormal-condition control loop controls driving of the rotary belt based on a signal output from the sensing unit.

5. A belt driving unit comprising:

a rotary belt on which a scale is formed;

a sensor that reads the scale;

a determining means for determining whether a color image or monochrome image is being formed;

a normal-position control loop that detects an actual speed of the rotary belt based on information of the scale read by the sensor, and controls the actual speed of the rotary belt to be constant;

an abnormal-condition control loop for a situation when an abnormality occurs in the normal-position control loop; and a loop-switchover timing controller that controls a switchover timing of a control loop between the normal-position control loop and the abnormal-condition control loop, wherein, when an abnormality occurs, the switchover timing is based on whether a color image or monochrome image is being formed.

6. The belt driving unit according to claim 5, further comprising a motor that rotates the rotary belt, wherein the abnormal-condition control loop controls driving of the rotary belt based on a signal from a frequency generator of the motor.

7. The belt driving unit according to claim 5, further comprising:

a motor that rotates the rotary belt; and an encoder that is attached to a shaft of the motor, wherein the abnormal-condition control loop controls the drive of the rotary belt based on a signal from the encoder.

8. The belt driving unit according to claim 5, wherein the abnormal-condition control loop includes a slit formed on a circumferential direction on an outer circumference of rollers that rotatably support the rotary belt; and a sensing unit arranged near the slit, and the abnormal-condition control loop controls driving of the rotary belt based on a signal output from the sensing unit.

9. An image forming apparatus comprising a belt driving unit that includes a rotary belt on which a scale is formed;

a sensor that reads the scale;

a determining means for determining whether a color image or monochrome image is being formed;

a normal-position control loop that detects an actual position of the rotary belt based on information of the scale read by the sensor, and corrects a position of the rotary belt based on the actual belt position detected;

an abnormal-condition control loop for a situation when an abnormality occurs in the normal-position control loop; and a loop-switchover timing controller that controls a switchover timing of a control loop between the normal-position control loop and the abnormal-condition control loop, wherein, when an abnormality occurs, the switchover timing of the control loop is based on whether a color image or monochrome image is being formed.

10. The image forming apparatus according to claim 9, wherein when a monochrome image is being formed, the loop-switchover timing controller performs the switchover of the control loop, coincident with the timing of the image formation.

11. An image forming apparatus comprising a belt driving unit that includes a rotary belt on which a scale is formed;

a sensor that reads the scale;

a determining means for determining whether a color image or monochrome image is being formed;

a normal-position control loop that detects an actual speed of the rotary belt based on information of the scale read by the sensor, and controls the actual speed of the rotary belt to be constant;

an abnormal-condition control loop for a situation when an abnormality occurs in the normal-position control loop; and a loop-switchover timing controller that controls a switchover timing of a control loop between the normal-position control loop and the abnormal-condition control loop, wherein, when an abnormality occurs, the switchover timing of the control loop is based on whether a color image or monochrome image is being formed.

12. The image forming apparatus according to claim 11, wherein when a monochrome image is being formed, the loop-switchover timing controller performs the switchover of the control loop, coincident with the timing of the image formation.

13. An image forming apparatus comprising a belt driving unit that includes a rotary belt on which a scale is formed;

a sensor that reads the scale;

a determining means for determining whether a color image or monochrome image is being formed;

a normal-position control loop that detects an actual position of the rotary belt based on information of the scale read by the sensor, and corrects a position of the rotary belt based on the actual belt position detected;

an abnormal-condition control loop for a situation when an abnormality occurs in the normal-position control loop; and a loop-switchover timing controller that controls a switchover timing of a control loop between the normal-position control loop and the abnormal-condition control loop, wherein the loop-switchover timing controller switches the control loop from the normal-position control loop to the abnormal-condition control loop, when the abnormality occurs in the normal-position control loop, and when the normal-position control loop returns to a normal state, switches the timing of the control loop from the abnormal-condition control loop to the normal-position control loop, based on whether a color image or monochrome image is being formed.

14. The image forming apparatus according to claim 13, wherein when a monochrome image is being formed, the loop-switchover timing controller performs the switchover of the control loop, coincident with the timing of the image formation.

15. An image forming apparatus comprising a belt driving unit that includes a rotary belt on which a scale is formed;

a sensor that reads the scale;

a determining means for determining whether a color image or monochrome image is being formed;

a normal-position control loop that detects an actual speed of the rotary belt based on information of the scale read by the sensor, and controls the actual speed of the rotary belt to be constant;

an abnormal-condition control loop for a situation when an abnormality occurs in the normal-position control loop; and a loop-switchover timing controller that controls a switchover timing of a control loop between the normal-position control loop and the abnormal-condition control loop, wherein the loop-switchover timing controller switches the control loop to the abnormal-condition control loop, when the abnormality occurs in the normal-position control loop, and when the normal-position control loop returns to a normal state, switches the timing of the control loop from the abnormal-condition control loop to the normal-position control loop, based on whether a color image or monochrome image is being formed.

16. The image forming apparatus according to claim 15, wherein when a monochrome image is being formed, the loop-switchover timing controller performs the switchover of the control loop, coincident with the timing of the image formation.

17. A method of switching a control loop for a belt driving unit that includes a rotary belt on which a scale is formed, a sensor that reads the scale, a normal-position control loop that detects an actual position of the rotary belt based on information of the scale read by the sensor, and corrects a position of the rotary belt based on the actual belt position detected, an abnormal-condition control loop for a situation when an abnormality occurs in the normal-position control loop, and a loop-switchover timing controller that controls a switchover timing of a control loop between the normal-position control loop and the abnormal-condition control loop, the method comprising:

determining whether a color image or monochrome image is being formed;

switching, when the abnormality occurs in the normal-position control loop, the control loop from the normal-position control loop to the abnormal-condition control loop; and switching, when the normal-position control loop returns to a normal state, the timing of the control loop from the abnormal-condition control loop to the normal-position control loop, based on whether a color image or monochrome image is being formed.

18. A method of switching a control loop for a belt driving unit that includes a rotary belt on which a scale is formed, a sensor that reads the scale, a normal-position control loop that detects an actual speed of the rotary belt based on information of the scale read by the sensor, and controls the actual speed of the rotary belt to be constant, an abnormal-condition control loop for a situation when an abnormality occurs in the normal-position control loop, and a loop-switchover timing controller that controls a switchover timing of a control loop between the normal-position control loop and the abnormal-condition control loop, the method comprising:

determining whether a color image or monochrome image is being formed;

switching, when the abnormality occurs in the normal-position control loop, the control loop from the normal-position control loop to the abnormal-condition control loop; and switching, when the normal-position control loop returns to a normal state, the timing of the control loop from the abnormal-condition control loop to the normal-position control loop, based on whether a color image or monochrome image is being formed.

19. The image forming apparatus according to claim 9, wherein when a color image is being formed, the loop-switchover timing controller performs the switchover of the control loop at a timing other than a timing of the image formation.

* * * * *